US011664586B2

(12) United States Patent
Hiller et al.

(10) Patent No.: US 11,664,586 B2
(45) Date of Patent: May 30, 2023

(54) NANOSATELLITE HIGH GAIN ANTENNA, FLUIDIZED RODS INCLUDING THE SAME, AND FLUIDIZED SUPPORTS

(71) Applicant: The Boeing Company, Chicago, IL (US)

(72) Inventors: Nathan D. Hiller, Irvine, CA (US); Kurt W. Loheit, Rolling Hills Estates, CA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 17/523,213

(22) Filed: Nov. 10, 2021

(65) Prior Publication Data

US 2022/0158334 A1 May 19, 2022

Related U.S. Application Data

(60) Provisional application No. 63/115,684, filed on Nov. 19, 2020.

(51) Int. Cl.

| | |
|---|---|
| ***H01Q 1/28*** | (2006.01) |
| ***H01Q 21/00*** | (2006.01) |
| ***H01Q 1/08*** | (2006.01) |
| ***H01Q 13/12*** | (2006.01) |

(52) U.S. Cl.

CPC ..... *H01Q 1/288* (2013.01); *H01Q 1/081* (2013.01); *H01Q 13/12* (2013.01); *H01Q 21/0068* (2013.01)

(58) Field of Classification Search

CPC ..... H01Q 1/288; H01Q 15/02; H01Q 15/08

See application file for complete search history.

(56) References Cited

U.S. PATENT DOCUMENTS 11,177,548 B1 11/2021 Hiller
2018/0183152 A1* 6/2018 Turpin ..... G06F 30/20

FOREIGN PATENT DOCUMENTS

DE 202019005521 U1 * 1/2021 ..... H01Q 15/08

* cited by examiner

*Primary Examiner* — Daniel Munoz
(74) *Attorney, Agent, or Firm* — Gates & Cooper LLP

(57) ABSTRACT

A nanosatellite or drone, including an antenna; a dielectric waveguide coupled to the antenna, the waveguide comprising at least one of a slot or a taper and the waveguide (1) focusing electromagnetic radiation incident from free space into the waveguide and (2) waveguiding the electromagnetic radiation to the antenna. Also disclosed is a system for deploying a support structure, or device having electromagnetic functionality, including one or more bags each having a wall comprising a membrane; one or more conduits each having an outlet transferring fluid into the one or more of the bags in fluidic communication with the conduits, wherein the fluid pressurizes each of the one or more bags and expands the membrane so as to deploy and form each of the one or more bags into a support or the device having electromagnetic functionality.

20 Claims, 20 Drawing Sheets

NANOSATELLITE HIGH GAIN ANTENNA, FLUIDIZED RODS INCLUDING THE SAME, AND FLUIDIZED SUPPORTS

CROSS REFERENCE TO RELATED APPLICATIONS

This application claims the benefit under 35 U.S.C. Section 119(e) of commonly-assigned U.S. Provisional Patent Application No. 63/115,684, filed Nov. 19, 2020, by Nathan D. Hiller and Kurt W. Loheit, entitled "NANOSATELLITE HIGH GAIN ANTENNA, FLUIDIZED RODS INCLUDING THE SAME, AND FLUIDIZED SUPPORTS,", which application is incorporated by reference herein.

BACKGROUND

1. Field

The present disclosure relates to methods and systems for manufacturing structures, waveguides and antennas for use on aircraft, nanosatellites, and other spacecraft.

2. Description of the Related Art

FIG. 1 illustrates a nanosatellite 100 having an antenna 102, wherein the antenna must be comparable in length to the RF wavelength 104 to efficiently receive and transmit radio frequency (RF) waves. For example, an RF wavelength of 4 meters (75 GHz) is large compared to a 10×10×10 cm nanosatellite. As a result, large antennas present a challenge for designing compact nanosatellites that can withstand high G loads at launch, and for docking with other spacecraft after launch because long antennas can get in the way. What is needed are antennas systems designed for smaller space structures and/or that can be deployed after launch. The present disclosure satisfies this need.

SUMMARY

Elements for transmitting or receiving electromagnetic radiation, support structures, and systems including the same, and associated methods are disclosed herein.

Illustrative, non-exclusive examples of inventive subject matter according to the present disclosure are described in the following enumerated paragraphs:

A1. An apparatus, comprising a nanosatellite or drone, comprising an antenna; and a waveguide coupled to the antenna, the waveguide comprising a dielectric:

focusing electromagnetic radiation incident from free space into the waveguide, waveguiding the electromagnetic radiation to the antenna, and comprising at least one of a slot or a taper.

B1. A system for deploying an element for transmitting or receiving electromagnetic radiation, comprising:

one or more bags each having a wall comprising a membrane; and one or more conduits each having an outlet transferring a fluid into the one or more of the bags in fluidic communication with the conduits, wherein the fluid pressurizes the one or more bags and expands the membrane so as to deploy and form each of the one or more bags into a rigid structure comprising the element for transmitting or receiving electromagnetic radiation.

C1. A system for deploying a support structure, comprising:

one or more bags each having a wall comprising a membrane; and one or more conduits each having an outlet transferring a fluid into the one or more of the bags in fluidic communication with the conduits, wherein the fluid pressurizes each of the one or more bags and expands the membrane so as to deploy and form each of the one or more bags into one or more supports.

BRIEF DESCRIPTION OF THE DRAWINGS

FIG. 2A-2B illustrates a waveguide comprising an RF capture rod coupled to an antenna on a satellite, wherein FIG. 2A illustrates a tapered rod and FIG. 2B illustrates a slotted rod.

DESCRIPTION

In the following description, reference is made to the accompanying drawings which form a part hereof, and which is shown, by way of illustration, several embodiments. It is understood that other embodiments may be utilized and structural changes may be made without departing from the scope of the present disclosure.

Technical Description

The present disclosure describes structures providing electromagnetic and/or mechanical functionality and that can be coupled to spacecraft or aircraft. Various embodiments are discussed in further detail in the following sections.

1. Nanosatellite Including a Waveguide Coupled Antenna

Figure 1:
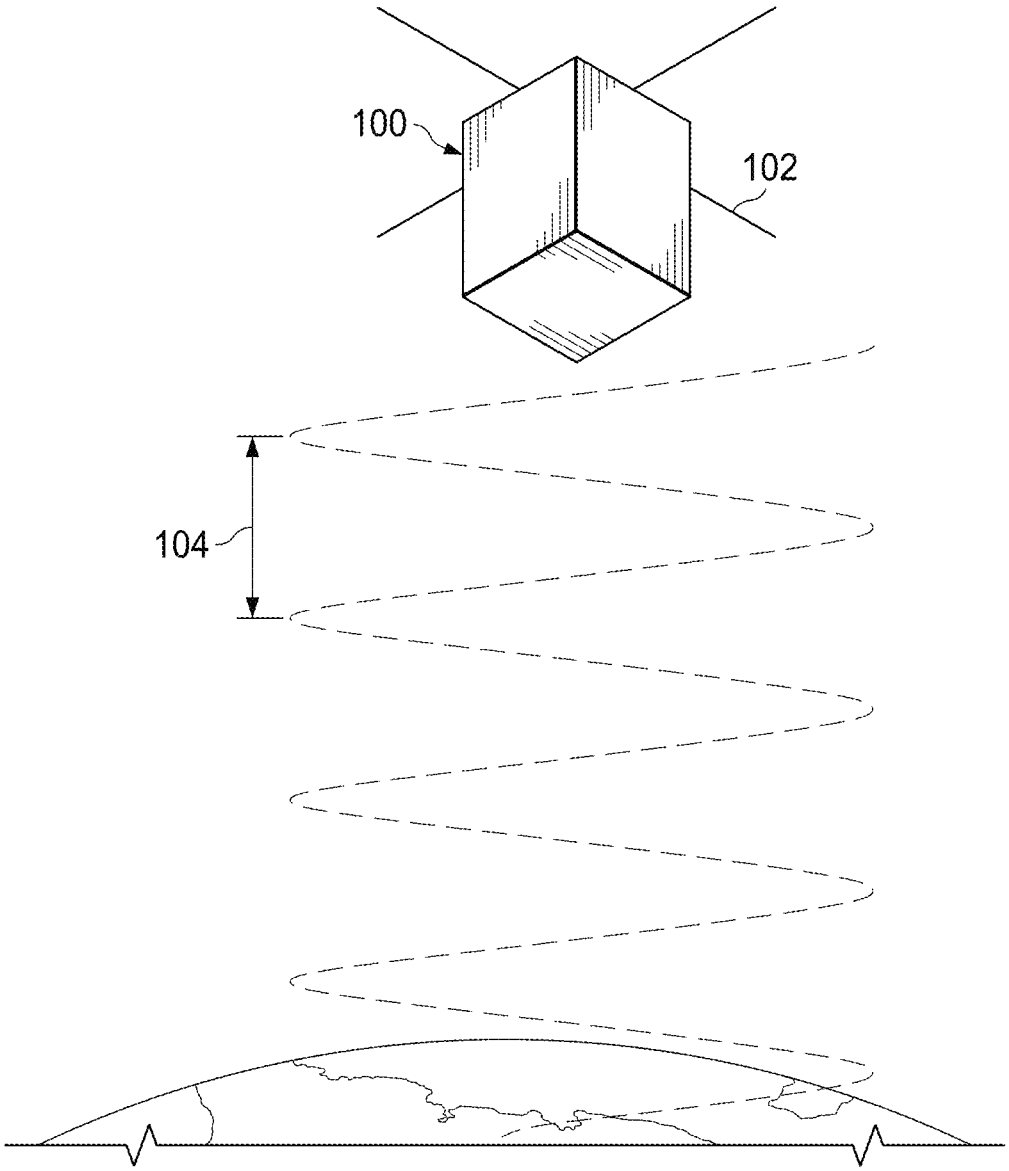
FIG. 1 illustrates an antenna for RF wavelengths attached to a nanosatellite.
Figure 2A:
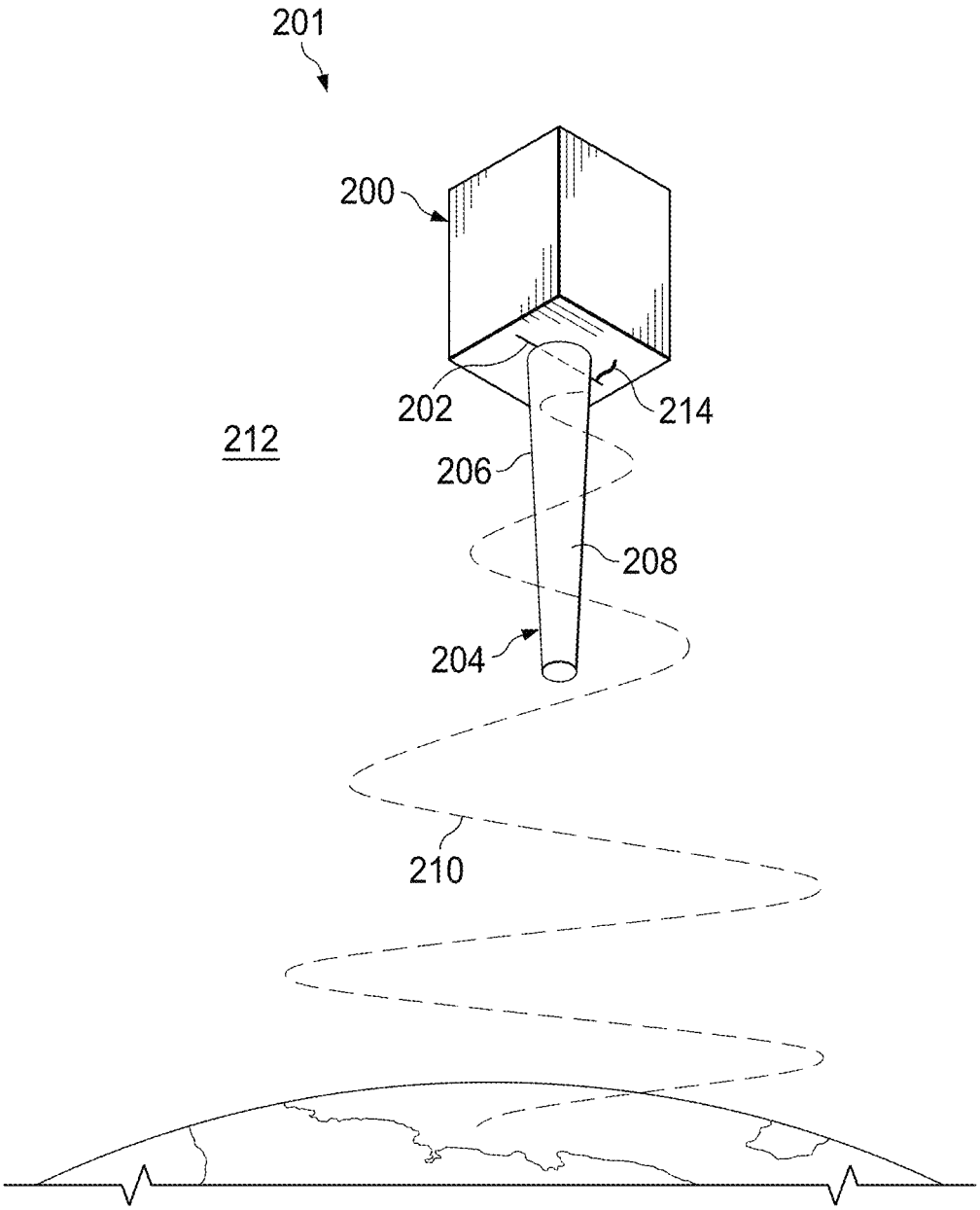
Figure 2B:
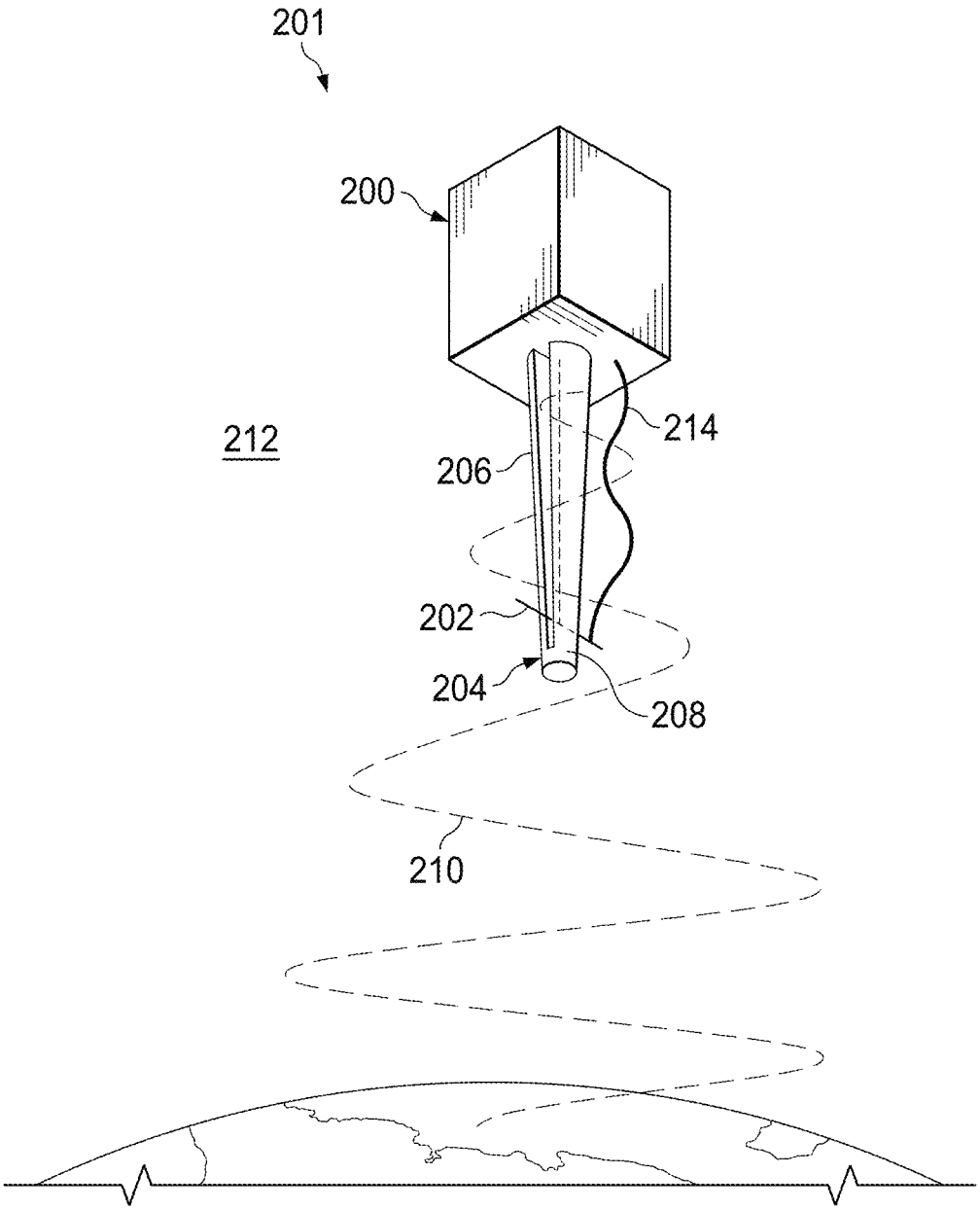

FIG. 2A illustrates a nanosatellite 200 comprising an antenna 202 (e.g., dipole antenna or probe) and a dielectric waveguide 204 coupled to the antenna 202. The waveguide is dimensioned, has a shape 206, and comprises a dielectric material 208 (1) focusing electromagnetic radiation 210 incident from free space 212 into the waveguide and (2) waveguiding the electromagnetic radiation to the antenna. FIG. 2 further illustrates a coaxial cable 214 connected to the antenna. Examples of nanosatellites include any satellite with mass from 1 kg to 10 kg (or 10 kg or less), such as, but not limited to, CubeSats, PocketQubes, TubeSats, SunCubes, ThinSats and picosatellites. In one or more examples, free space comprises a region outside the waveguide and in air, atmosphere, vacuum and/or outer space in orbit around a planet. FIG. 2B illustrates a waveguide comprising a slotted RF capture rod coupled to an antenna on a satellite.

Figure 3A:
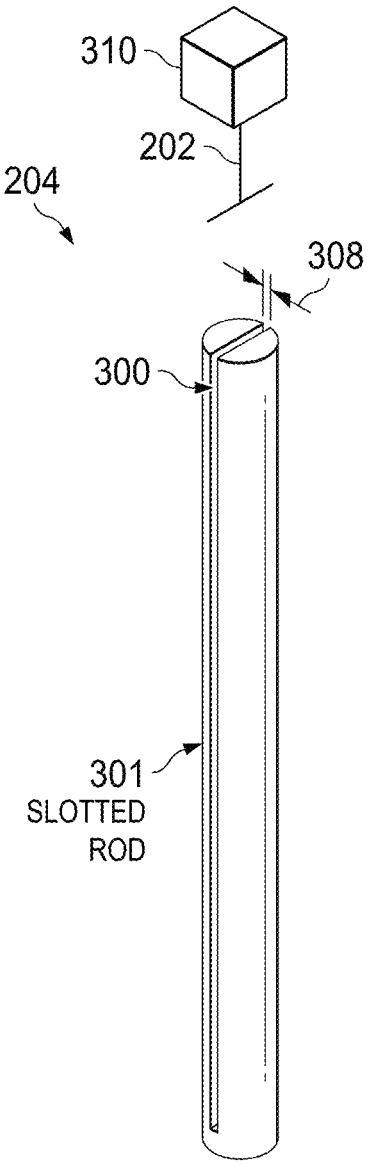
FIG. 3A illustrates an example waveguide comprising a slotted rod.
Figure 3B:
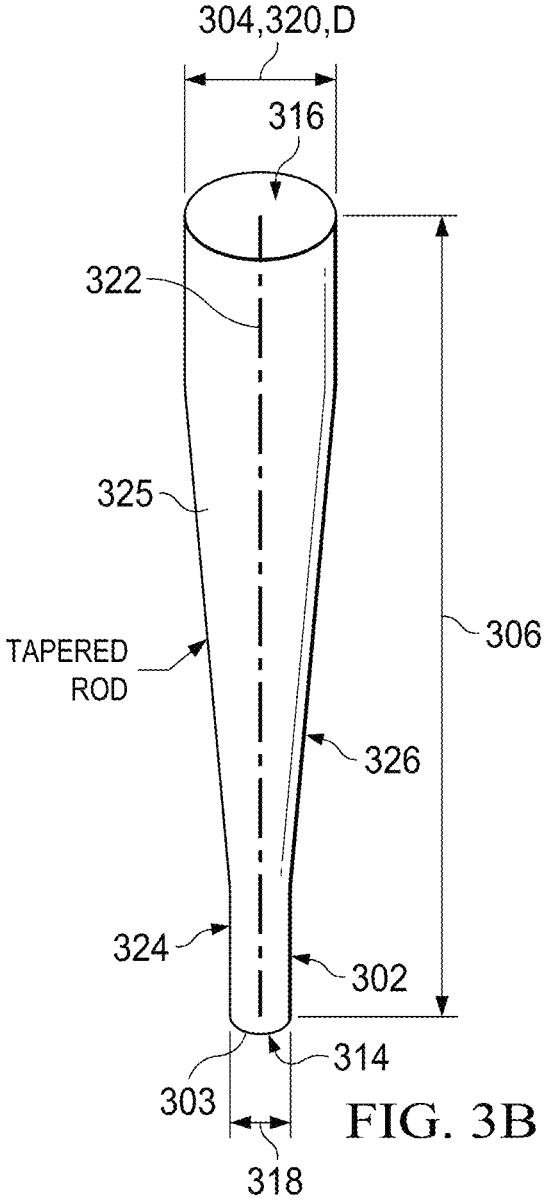
FIG. 3B illustrates an example waveguide comprising a tapered rod.

FIG. 3A illustrates the waveguide 204 comprising a slot 300 and FIG. 3B illustrates the waveguide 204 including a taper 302. FIG. 3A and FIG. 3B illustrate the waveguide has a front face 303 facing the incident electromagnetic radiation. In some examples, the front face includes an antireflective rod segment that acts as an antireflective coating or anti-reflective element for the electromagnetic radiation.

The dimensions and shape 206 of the waveguide, and dielectric material, are modifiable for various applications. Example shapes of the waveguide include, but are not limited to, the waveguide comprising a polyhedron (e.g., a cylinder or rod) having, for example a circular, polygonal, or rectangular cross-section. Example dimensions of the waveguide include, but are not limited to, a width 304 a factor of at least a 100 times smaller than a wavelength of the electromagnetic radiation in free space 212. In one or more examples, the waveguide has the dimensions including a length 306 at least 2 times a diameter or width of the waveguide. In one or more further examples, the waveguide has a width 304 a range of 1-5 cm and a length 306 in a range of 5-20 centimeters (cm).

In one or more further examples, the slot 300 is dimensioned (e.g., has a slot width 308) to accommodate the antenna, so that the antenna is capable of being positioned within the slot where the electromagnetic radiation in the waveguide has a peak electric field. In various examples, the antenna is tuned to receive the peak electric field and a mechanism 310 (e.g., a translation stage or mount) is provided to hold the antenna at the position 312 of the peak electric field.

In yet one or more further examples, the dielectric waveguide 204 comprises a first end 314 and a second end 316, the antenna 202 is coupled to the second end, the taper 302 is at the first end 314 so that the first end 314 has a first width 318 narrower than second width 320 of the second end, and the waveguide waveguides the electromagnetic radiation 210 from the first end to the second end. In some taper examples, the waveguide also includes a slot 300 and the slot also has a taper. Example geometries for the taper (in the slot or waveguide) include, but are not limited to, the taper having a linear, quadratic, or exponential shape wherein the surface 325 of the taper comprises a surface of revolution formed by rotating a line, a quadratic curve or parabola, or exponential curve about an axis of rotation coincident with the longitudinal axis 322 of the rod comprising the waveguide. In further examples, the taper varies along a length of the waveguide from a first taper 324 having a first shape (e.g., linear shape, parabolic/quadratic shape, or exponential shape) to a second taper 326 having a second shape (linear shape, parabolic shape, or exponential shape), e.g., so that the taper changes between at least one of the linear shape, the quadratic/parabolic shape, or the exponential shape.

Example dielectric materials 208 include, but are not limited to, dielectric materials that have a dielectric constant that shrink the wavelength of the electromagnetic radiation to confine the electromagnetic radiation in a single mode within the waveguide. In one or more examples, the dielectric material has a dielectric constant greater than 5 or in a range of 5-20 (e.g., for the electromagnetic radiation having a frequency f in a range 100 MHz≤f≤1 GHz). Further examples of dielectric material include, but are not limited to, strontium titanate, fluid (e.g., water), a mixture of one or more fluids, ice, or alumina. In one example, the waveguide comprises ice formed from water freezing in a container (e.g., bag, balloon). In one or more further examples, the slot is filled with a liquid having a refractive index that matches (e.g., is the same as) that of the waveguide (e.g., rod).

In one or more examples, the dielectric waveguide comprises a width and dielectric constant wherein the waveguide is impedance matched to the antenna so as to tailor a gain and bandwidth of the antenna for the electromagnetic radiation (e.g., having a frequency f in a range 100 MHz≤f≤1 GHz). In one or more examples, the dimensions and dielectric material of the waveguide are tailored so that the bandwidth is less than 3 dB for the electromagnetic radiation having a center frequency f in a range of 100 MHz≤f≤1 GHz.

In one or more examples, the antenna coupled to the waveguide is shorter (e.g., seventeen times shorter than a conventional antenna not coupled to the waveguide) because the waveguide between the electromagnetic radiation and the antenna has a high refractive index reducing the wavelength of the electromagnetic radiation (e.g., by a factor about equal to the inverse of the waveguide's refractive index). Moreover, the waveguide provides additional signal gain because the high refractive index and shape of the waveguide focus the wave of the electromagnetic radiation into the waveguide and onto the antenna.

As used herein gain is defined as gain=I2/I1 (linear units) where the electromagnetic radiation 210 comprises an first EM plane wave having an intensity I1 in free space (e.g., outside the waveguide and in air, atmosphere, vacuum and/or outer space in orbit around a planet) and a second EM wave having an intensity I2 after being concentrated or focused by the rod. In one or more examples, gain is used describes the focusing power of the rod.

Figure 3F:
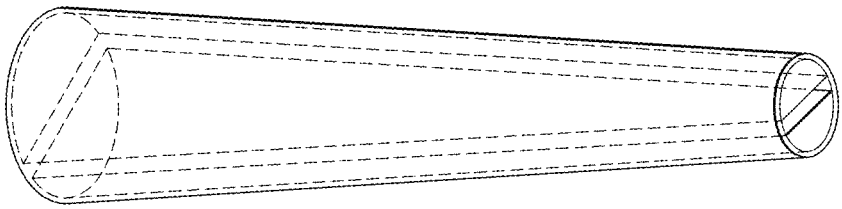
FIG. 3F illustrates an example wherein the out surfaces of the slotted rod are embedded in a lower index of refraction material.
Figure 3E:
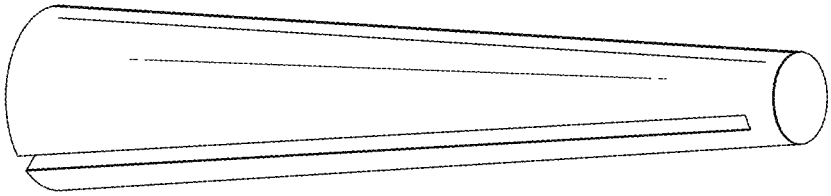
FIG. 3E illustrates an example of a slotted rod wherein the rod is not completely cut in half at one end so that the non slotted thinner end provides support for each of the sections of the rod.
Figure 3D:
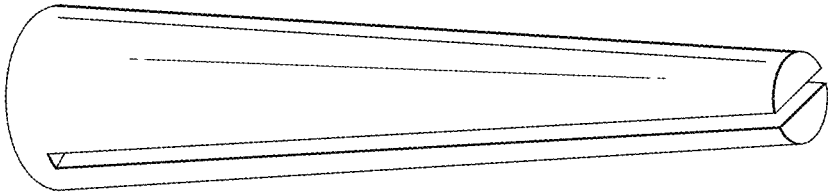
FIG. 3D illustrates an example of a slotted rod wherein the rod is not completely cut in half at one end so that the non slotted thicker end provides support for each of the sections of the rod.
Figure 3C:
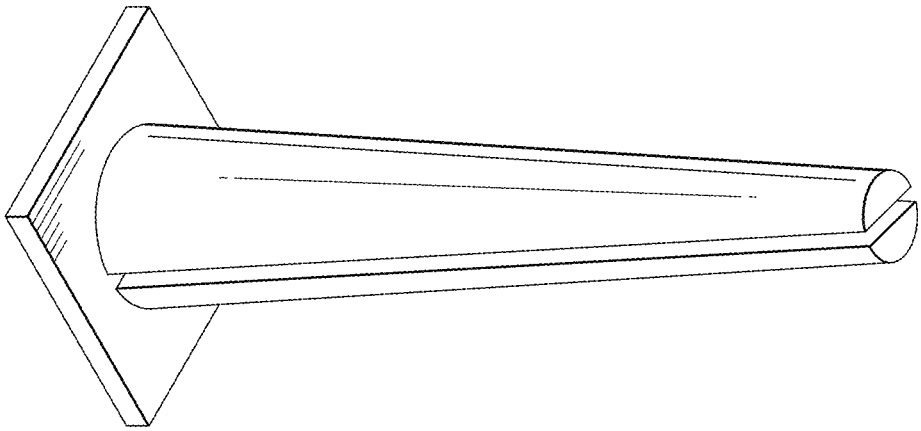
FIG. 3C illustrates an example of a slotted rod connected to a base mount on the nanosatellite.

FIG. 3C illustrates an example wherein the slotted rod is supported or attached to the nanosatellite using base mount supporting both sections of rod separated by the slot. FIG. 3D and FIG. 3E illustrate an example wherein the slotted rod is not entirely cut in half, so that the end of the rod (as illustrated in Fig. D) or the beginning of the rod (as illustrated in FIG. 3E) could be joined (that is never cut) to provide support. FIG. 3F illustrates an example wherein outer surfaces of the two halves of the slotted rod are embedded into a low refractive material (e.g., silica aerogel).

Figure 4:
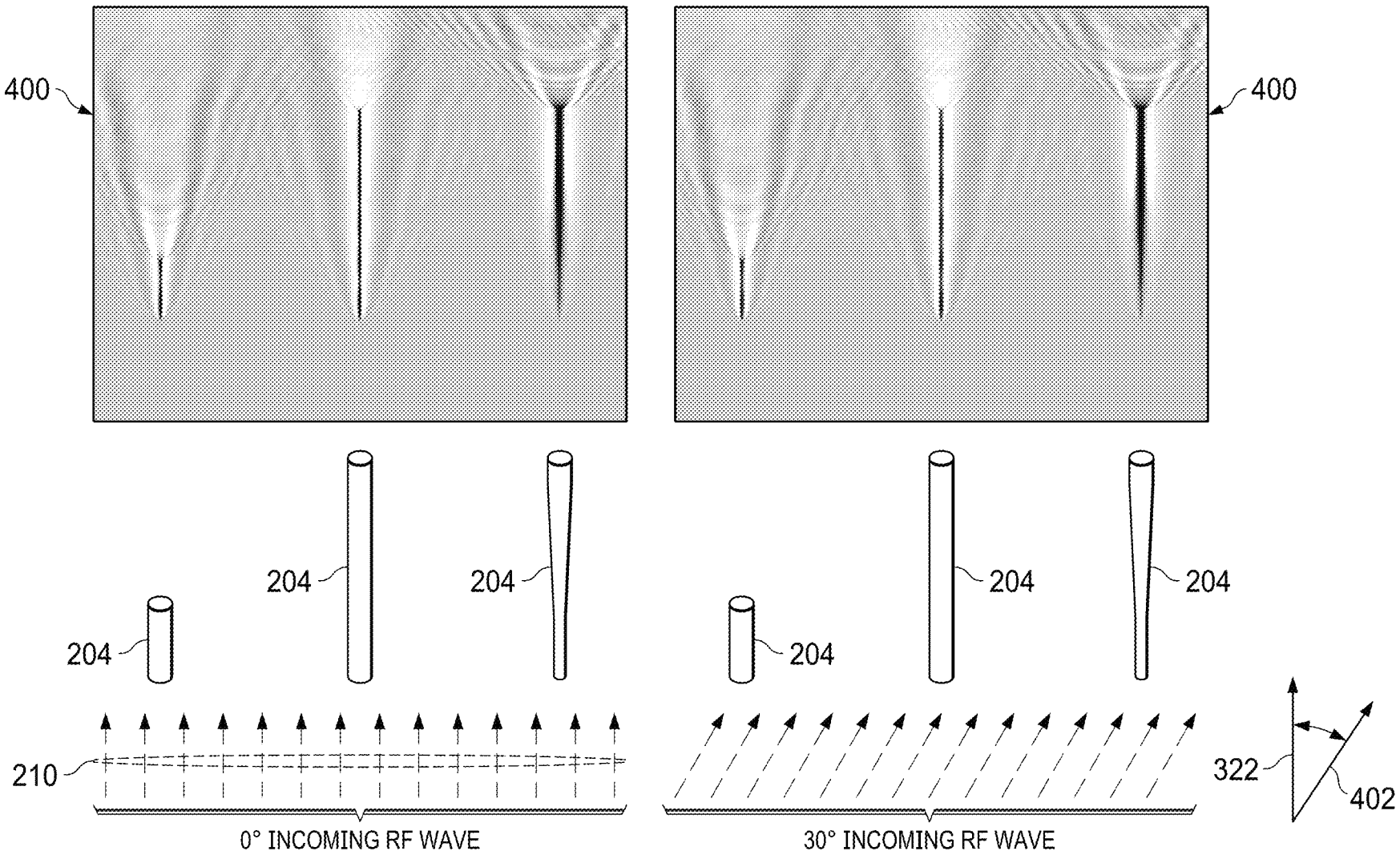
FIG. 4 illustrates the electric field within the waveguide for waveguides having 4 inch length, 14 inch length, and a taper, and for angles of incidence of the electromagnetic radiation on the waveguides of 0 degrees and 30 degrees.

Although FIG. 2 illustrates an apparatus 201 comprising a nanosatellite, in other examples the apparatus comprises an aircraft (e.g., a drone) or spacecraft comprising the waveguide.

a. Example Characterizations (i) Effect of Orientation of Incoming Electromagnetic Radiation FIG. 4 is a simulation showing the waveguide 204 is able to focus and waveguide the electric field 400 electromagnetic radiation 210 for a range of angles of incidence 402 (with respect to a longitudinal axis 322 of the waveguide) of the electromagnetic radiation 210 on the waveguide. The data shows the degree of focusing and waveguiding does not decrease significantly as the angle of incidence is increased from 0 degrees to 30 degrees. However, the degree of focusing and waveguiding is increased as the length of the waveguide is increased and when the waveguide is provided with the taper.

(ii) Bandwidth

Figure 5:
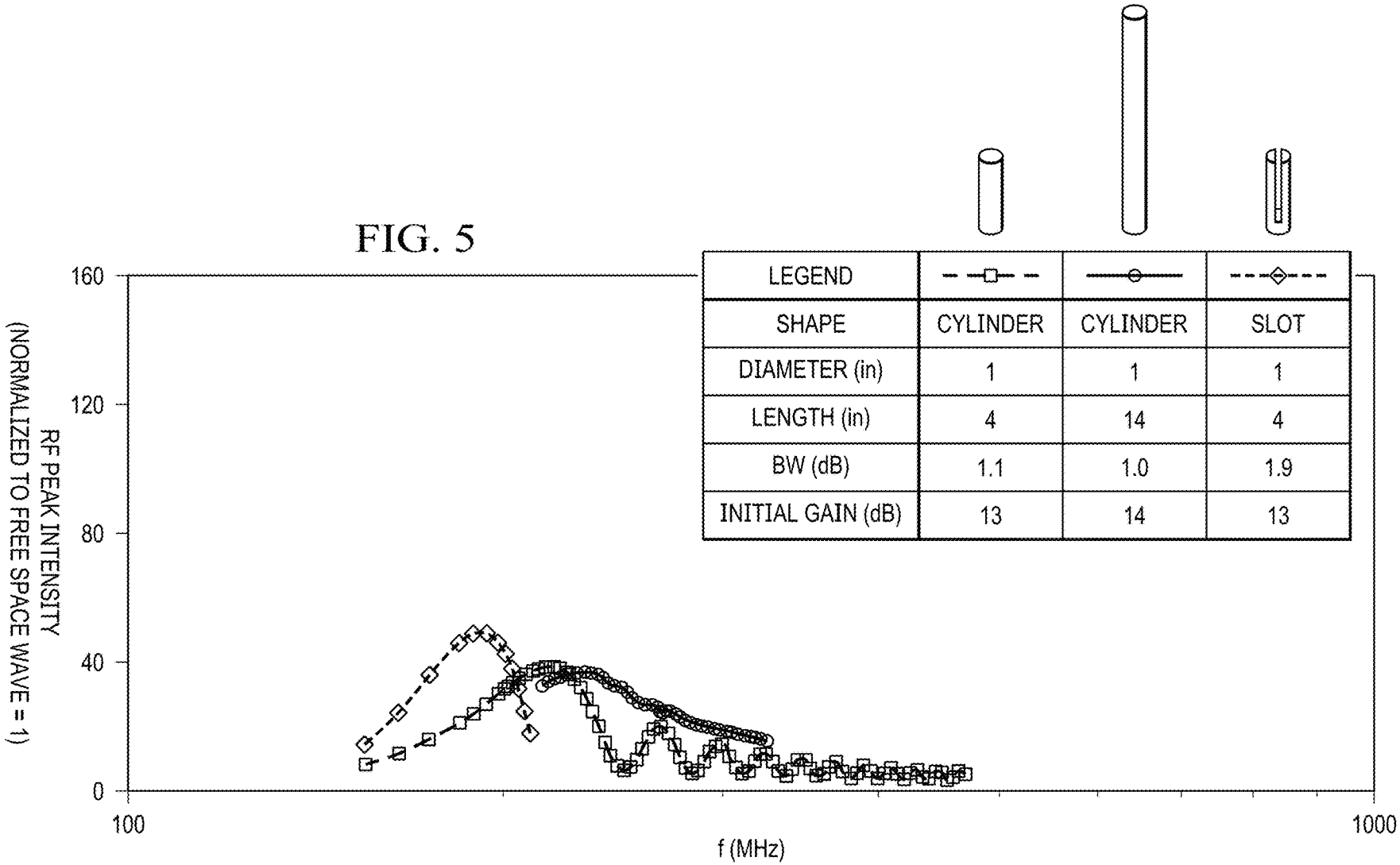
FIG. 5 plots RF peak intensity (normalized to the free space wave having an intensity=1) in the waveguide as function of frequency of the electromagnetic radiation, for waveguides having different length (4 inches and 14 inches) and for a waveguide having a length of 4 inches and including a slot.

FIG. 5 is a simulation showing a slot in the waveguide significantly increases the gain and bandwidth of the waveguide (bandwidth is increased by nearly a factor of 2 for electromagnetic radiation having a frequency of 200 MHz and a 2 mm wide slot). Increasing the waveguide length alone has little effect on the intensity of the gain and the bandwidth.

Figure 6:
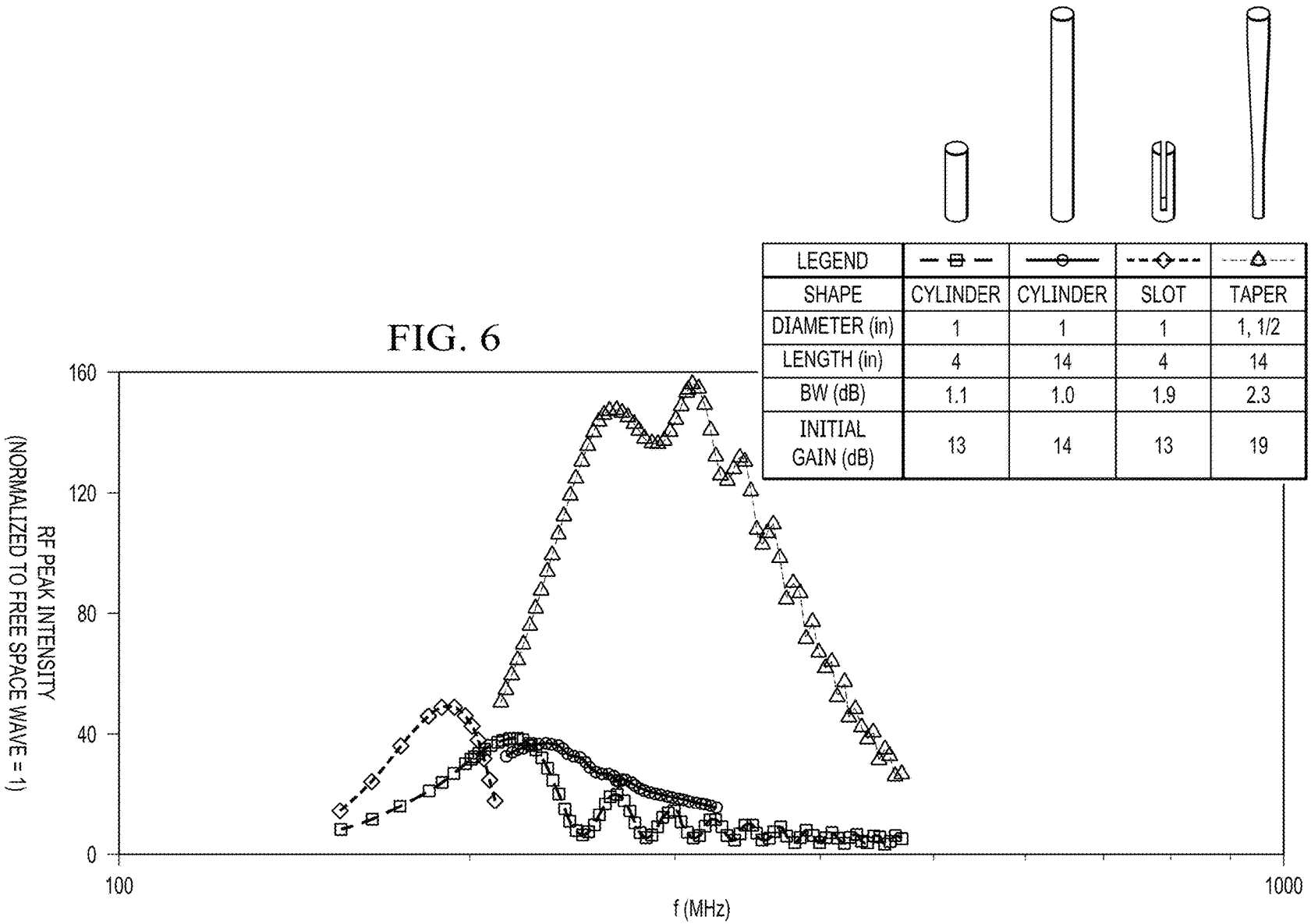
FIG. 6 plots RF peak intensity (normalized to the free space wave having an intensity=1) in the waveguide as function of frequency of the electromagnetic radiation, for waveguides having different length (4 inches and 14 inches), a waveguide having a length of 4 inches and including a slot, and a waveguide having a length of 14 inches and including a taper.

FIG. 6 shows increasing waveguide length and providing a taper significantly increases intensity of the gain and bandwidth. For electromagnetic radiation having a frequency of 200 MHz, increasing the length of the waveguide from 4 inches to 14 inches and including a taper increases the gain from 13 to 19 dB and increases the bandwidth from 1.1 to 2.3 dB.

(iii) Focusing, Confinement, and Waveguiding

Figure 7:
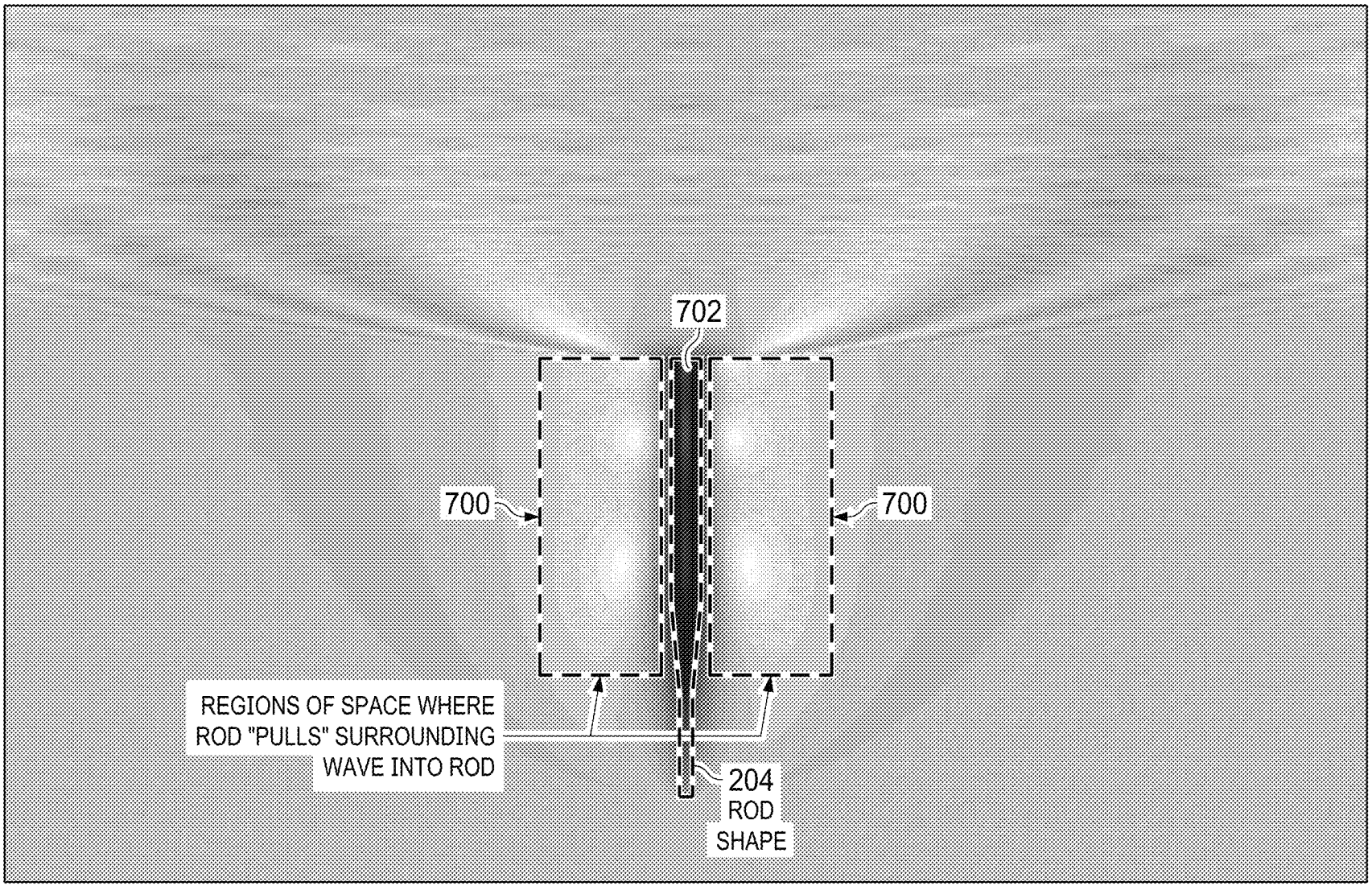
FIG. 7 plots electric field of the electromagnetic radiation in and around the waveguide.

FIG. 7 is a simulation showing the electric field of the electromagnetic radiation in the waveguide, evidencing the waveguide has the shape and dielectric material focusing, confining, and waveguiding the electromagnetic radiation in the waveguide. The focusing and confinement is evidenced by regions 700 of space on either side of the waveguide where the waveguide has removed or "pulled" the surrounding wave or electric field 702 of the electromagnetic radiation into the waveguide.

Figure 8A:
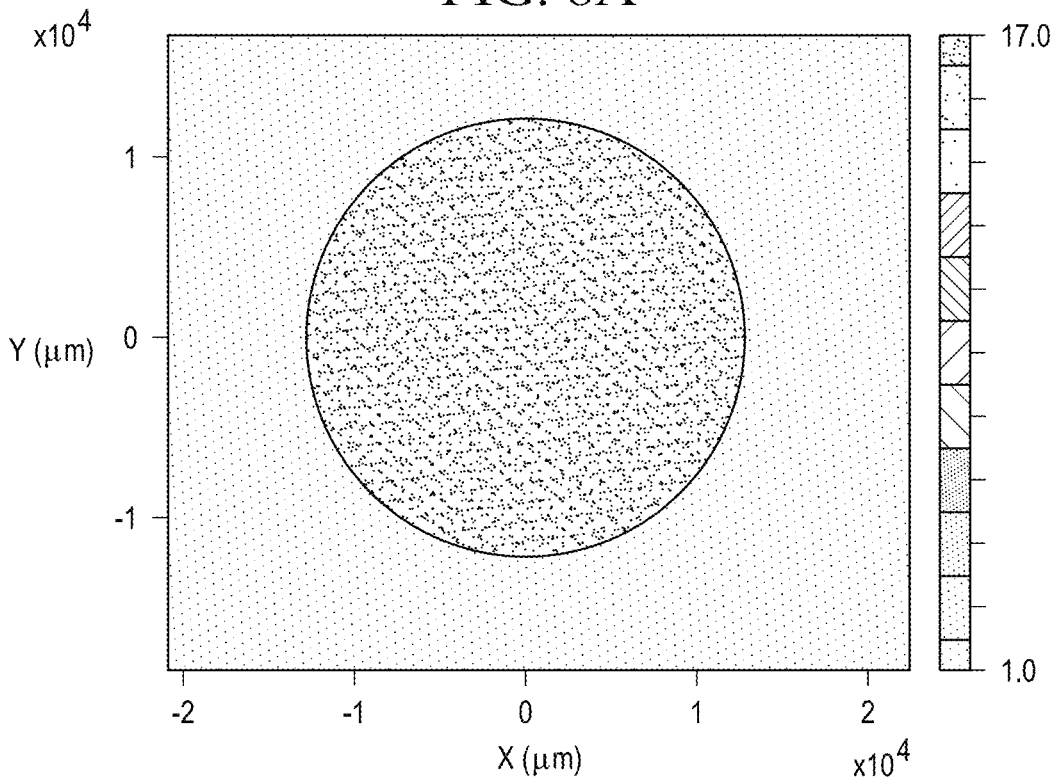
FIG. 8A is a cross-section showing the refractive index profile of the waveguide comprising a uniform rod.
Figure 8B:
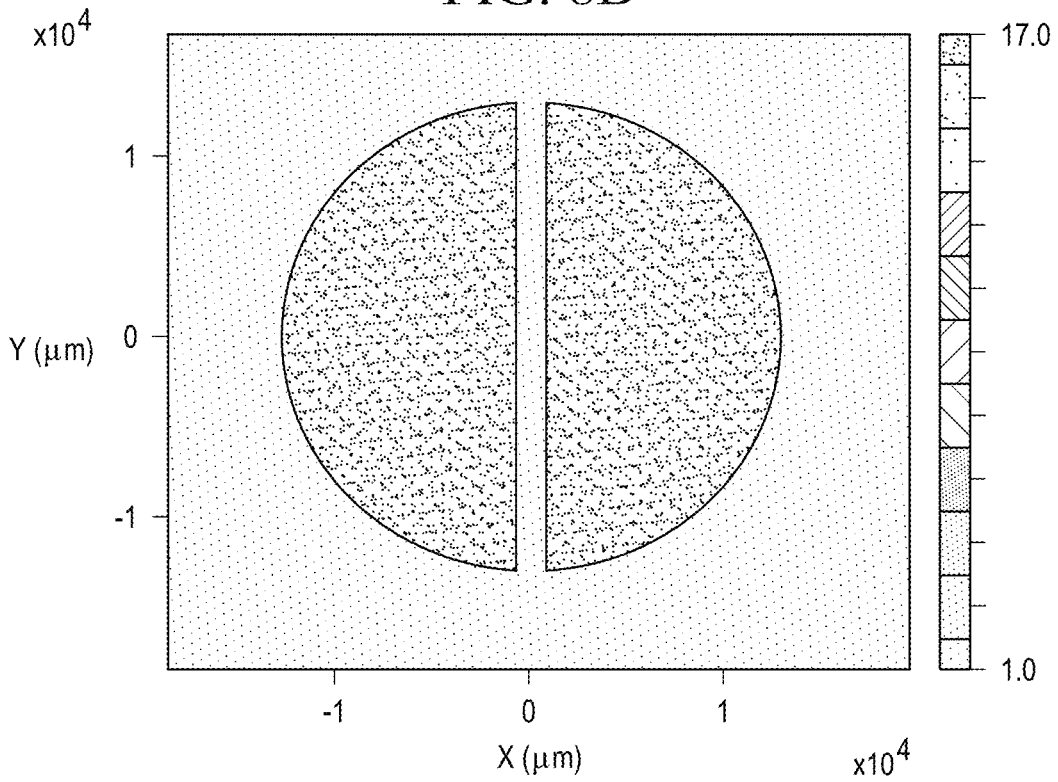
FIG. 8B is a cross-section showing the refractive index profile of the waveguide comprising a split rod having a 2 mm wide slot.
Figure 8C:
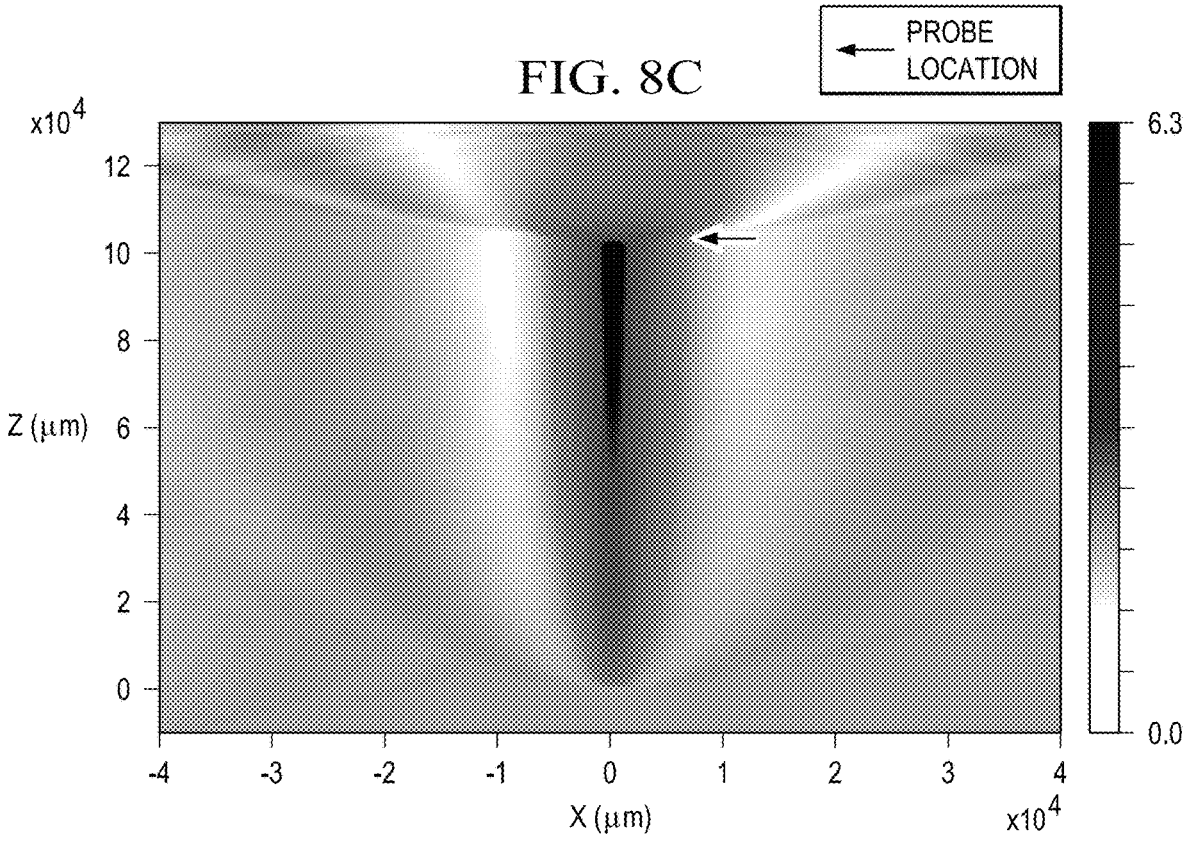
FIG. 8C illustrates the electric field amplitude of the electromagnetic radiation having 218 MHz frequency in the waveguide comprising the uniform rod of FIG. 8A, wherein the arrow indicates the probe location.
Figure 8D:
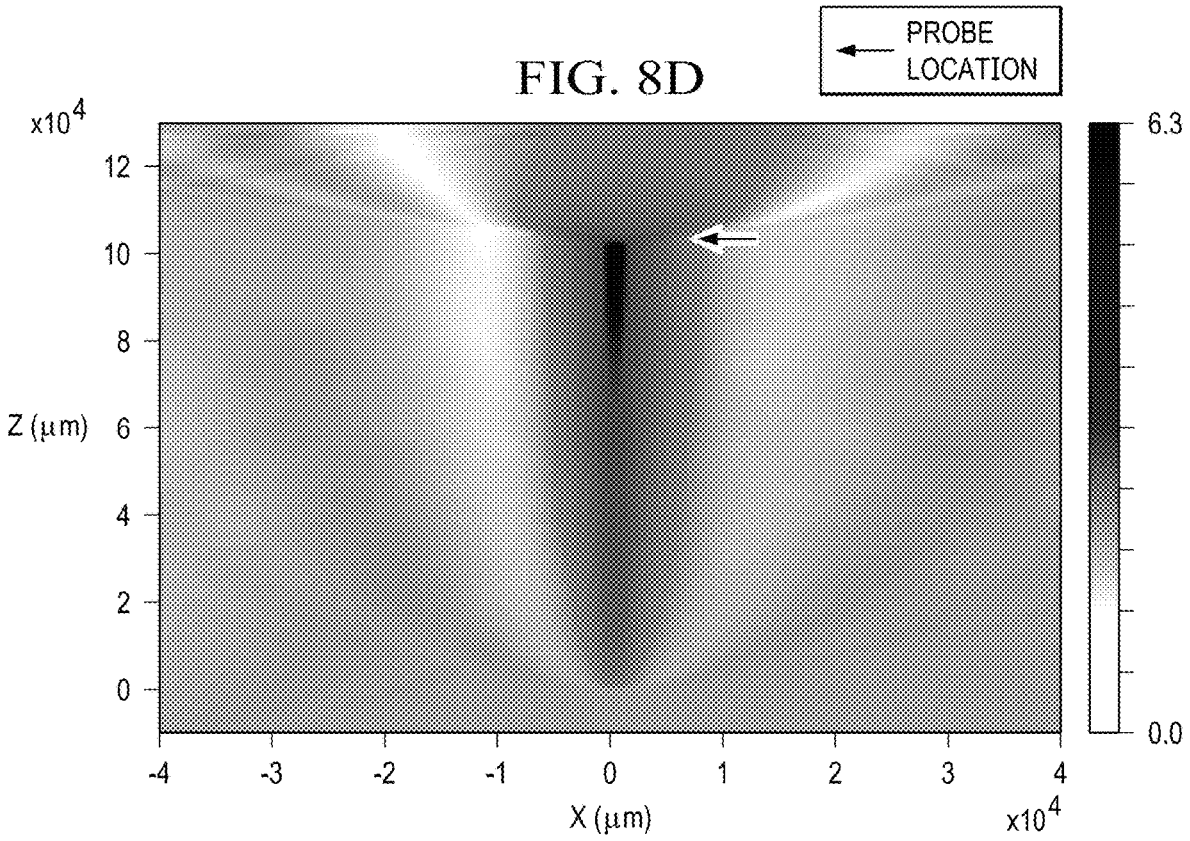
FIG. 8D illustrates the electric field amplitude of the electromagnetic radiation having 218 MHz frequency in the waveguide comprising the split rod of FIG. 8B, wherein the arrow indicates the probe location.
Figure 8E:
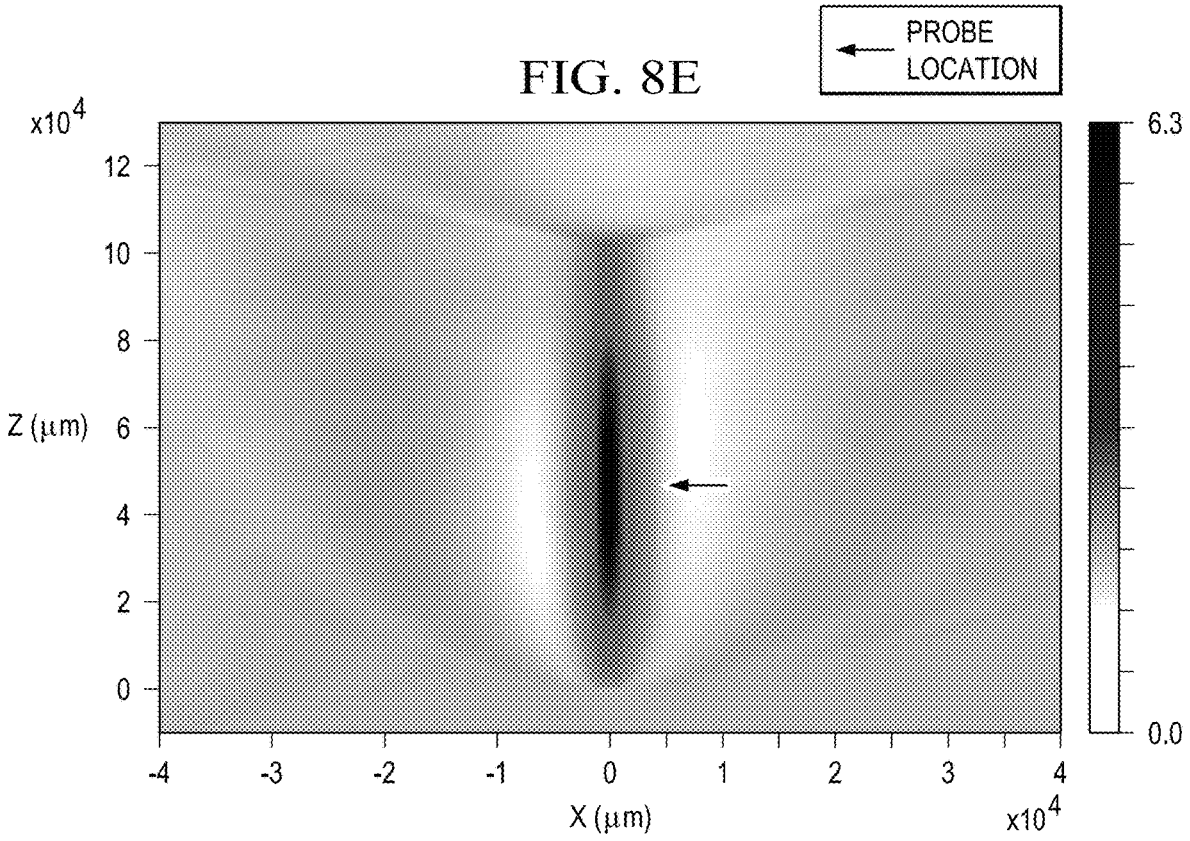
FIG. 8E illustrates the electric field amplitude of the electromagnetic radiation having 250 MHz frequency in the waveguide comprising the uniform rod of FIG. 8A, wherein the arrow indicates the probe location.
Figure 8F:
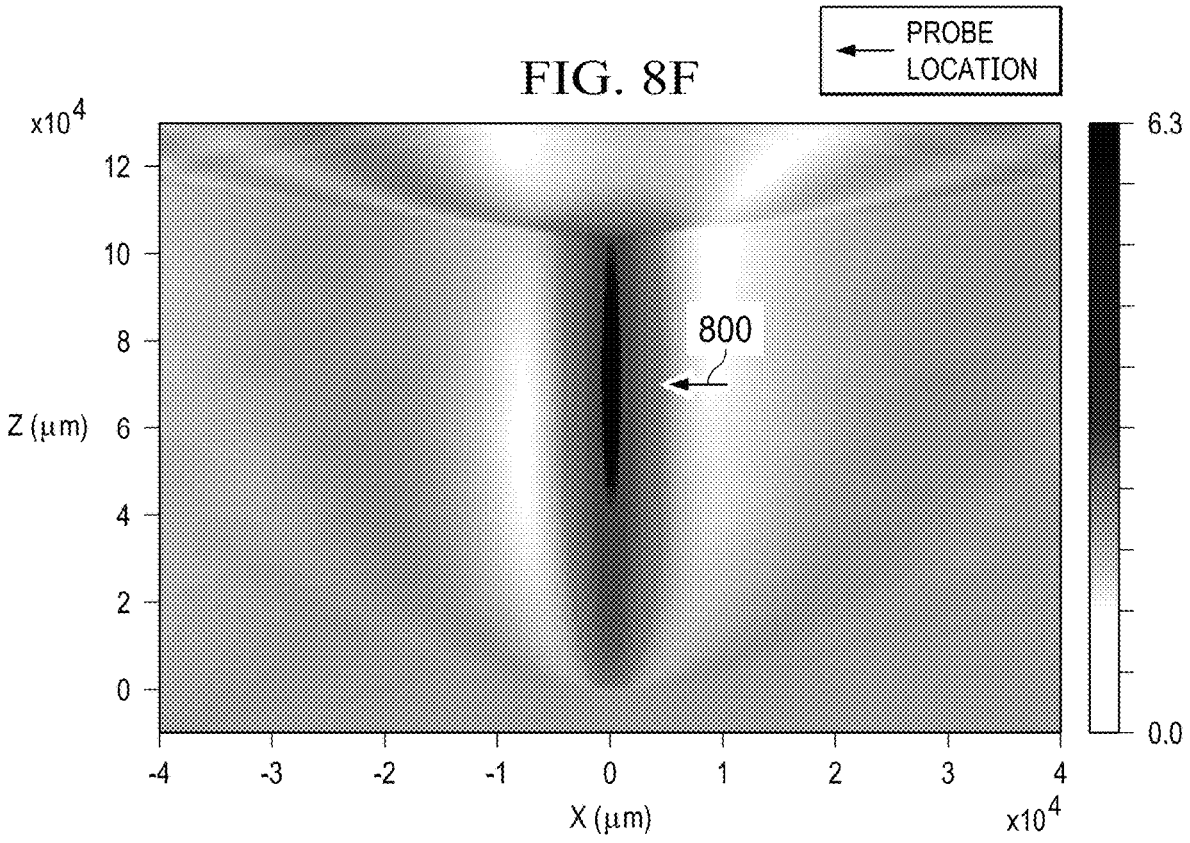
FIG. 8F illustrates the electric field amplitude of the electromagnetic radiation having 250 MHz frequency in the waveguide comprising the split rod of FIG. 8B, wherein the arrow indicates the probe location.

FIGS. 8A-8F illustrates the waveguide including the slot has little effect on intensity of gain but significantly increases bandwidth. For electromagnetic radiation having a frequency of 200 MHz, including a 2 mm slot in the waveguide increases the bandwidth from 1.1 dB to 1.9 dB. Moreover, FIGS. 8E and 8F show including the slot moves the position 800 of the peak electric field in the waveguide from the end of the waveguide towards a middle of the waveguide. FIG. 8E and FIG. 8F further show the antenna or probe is positioned within the slot at a position of the peak electric field.

Figure 9A:
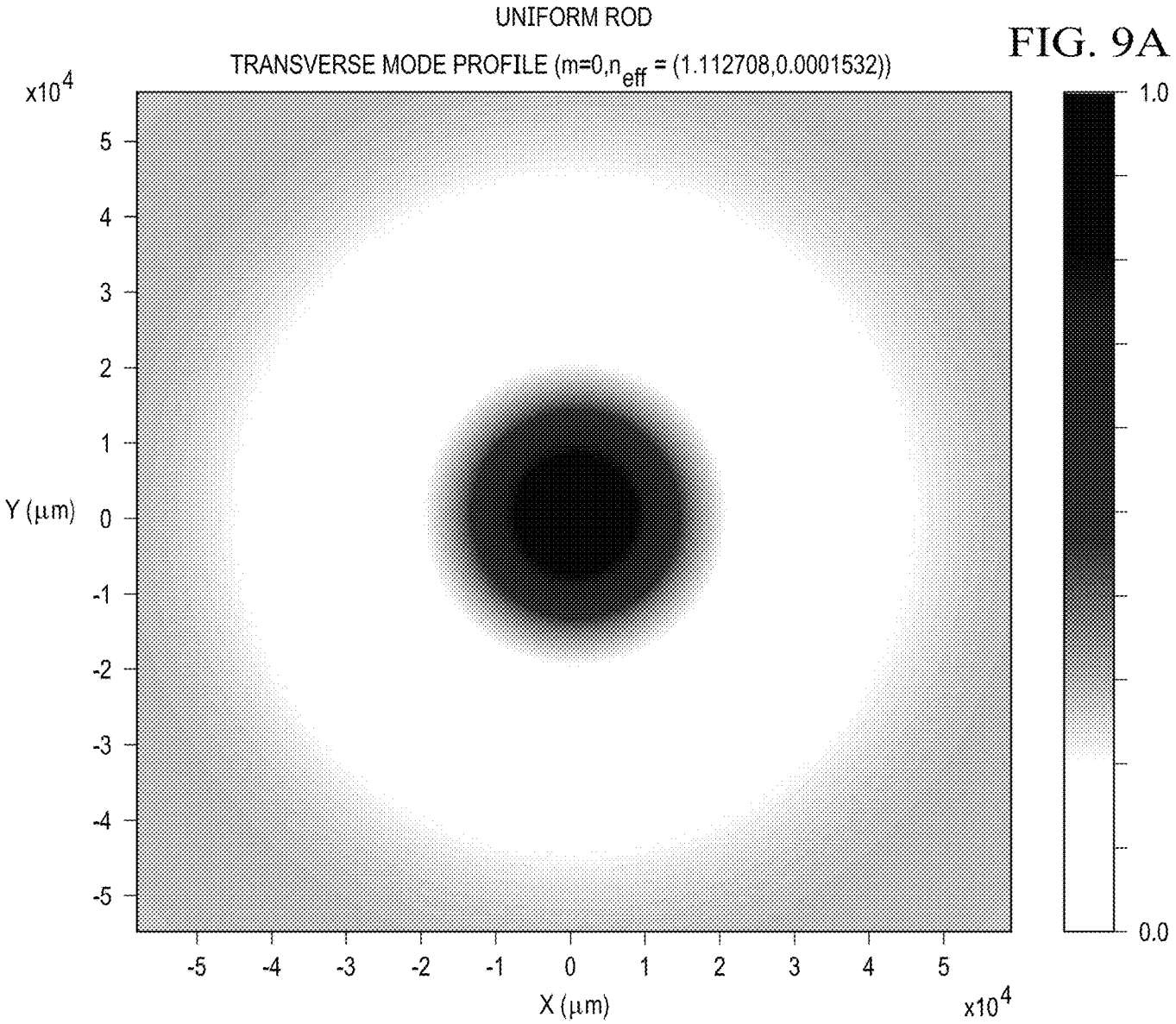
FIG. 9A illustrates the transverse mode profile of the electromagnetic radiation in the waveguide comprising a uniform rod.
Figure 9B:
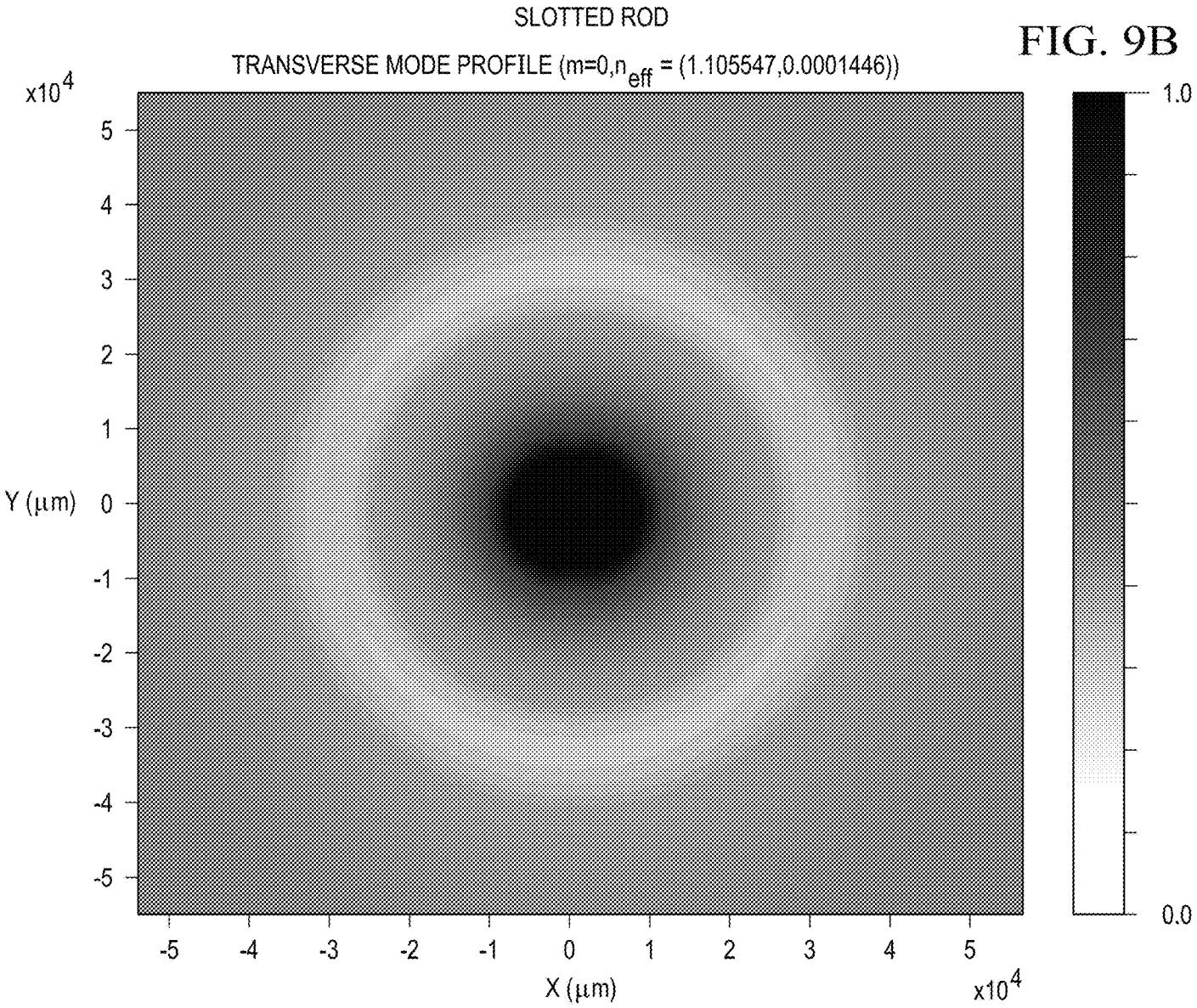
FIG. 9B illustrates the transverse mode profile of the electromagnetic radiation in the waveguide comprising a slotted rod.

FIGS. 9A-9B show the mode profile of the electromagnetic radiation in the waveguide is not significantly impacted by the slot and shows only a slight asymmetry.

2. Electromagnetic Elements Comprising a Fluidized and Expandable Membrane

Figure 10:
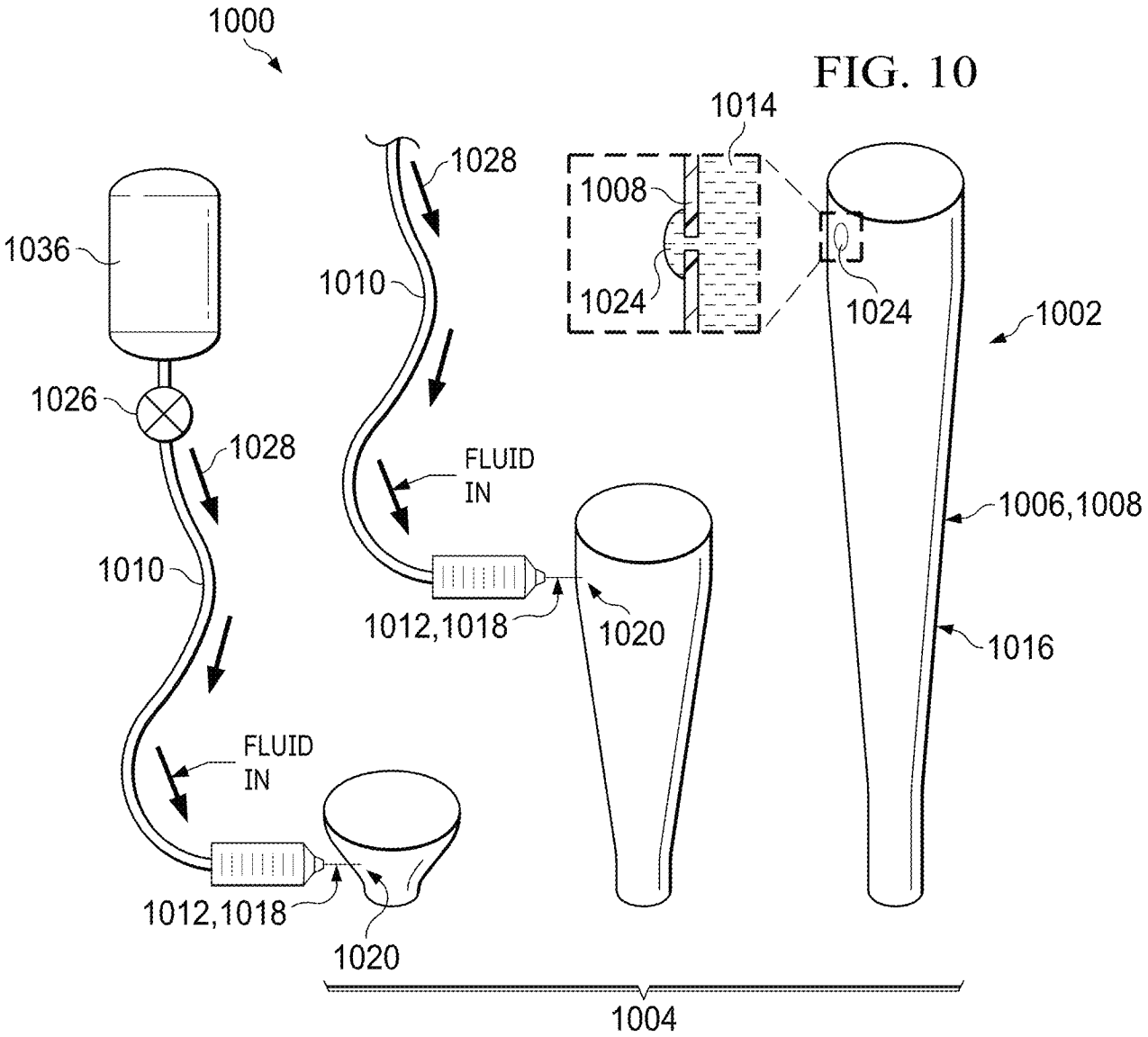
FIG. 10 illustrates a fluidized rod enabling a nanosatellite to deploy an antenna with smaller size and weight as compared to without the fluidized rod.

FIG. 10 illustrates a system 1000 for deploying an element 1002 for transmitting or receiving electromagnetic radiation 210, comprising one or more bags 1004 each having a wall 1006 comprising a membrane 1008; and one or more conduits 1010 each having an outlet 1012 transferring fluid 1014 into the one or more of the bags in fluidic communication with the conduits. The fluid transferred to the one or more bags pressurizes the one or more bags and expands the membrane so as to deploy and form each of the one or more bags into a rigid structure 1016 (e.g., a rod) comprising the element for transmitting or receiving electromagnetic radiation.

Example materials for the membrane include, but are not limited to, an elastomer or a plastic. Examples of the fluid include, but are not limited to, water or a mixture of fluids.

In one example, the outlet comprises a needle 1018 puncturing the membrane with a hole 1020 and injecting the fluid into the bag through the hole. In various examples, a sealant 1024 is provided to seal the hole. In some examples, the fluid comprises the sealant. In one or more examples, the sealant comprises a liquid additive that is cured or becomes a solid to seal the hole upon ultraviolet radiation from a space environment 1250 or heat. In yet further examples, the sealant comprises a liquid additive that is cured or becomes a solid upon exposure to the low gas pressure (vacuum) environment of space.

Figure 11:
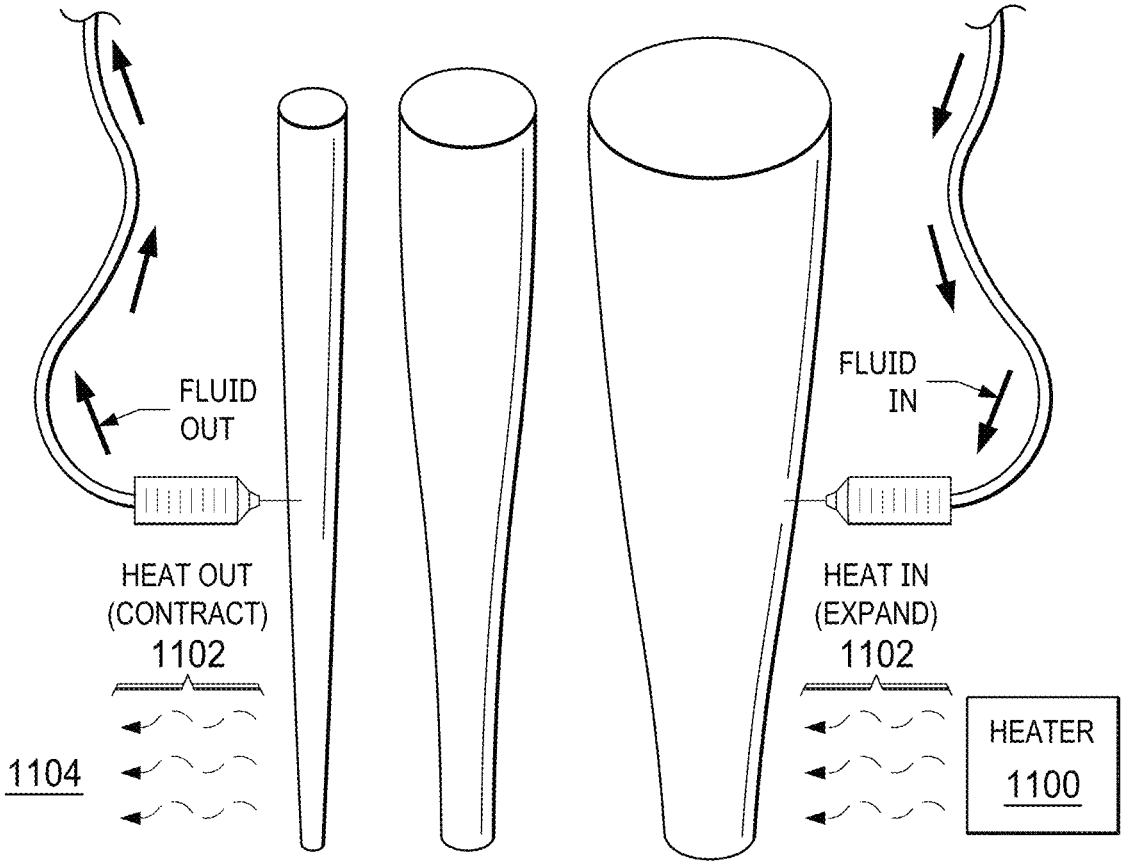
FIG. 11 illustrates fluid injection and extraction from expandable membrane enables center frequency tuning of rod. In addition, exposing the fluidized rod to space (e.g., a shadow) will release thermal radiation causing the rod to contract via thermal contraction and exposing the fluidized rod to heat allows thermal expansion of the rod.

In one or more examples, the element for transmitting or receiving electromagnetic radiation 210 comprises an antenna 202 or a waveguide 204 (e.g., as described in section 1) having a bandwidth including a center frequency (the center frequency in the bandwidth of frequencies. In various examples, one or more valves 1026 coupled to the conduits regulate one or more flows 1028 of the fluid into or out of the one or more bags, so as to tune the center frequency. FIG. 11 illustrates an example wherein a heater 1100 outputs heat 1102 heating the fluid so as to cause an expansion of the one or more bags that tunes the center frequency. In yet further examples, the membrane comprises a material that contracts under cooling in outer space 1104 so as to tune the center frequency.

FIG. 10 further illustrates a reservoir 1036 storing the fluid. In various examples, the reservoir contains only enough fluid to form one of the bags to deploy a rod of choice. In other examples, the reservoir enables many antennas to be positioned around the nanosatellite.

Figure 12A:
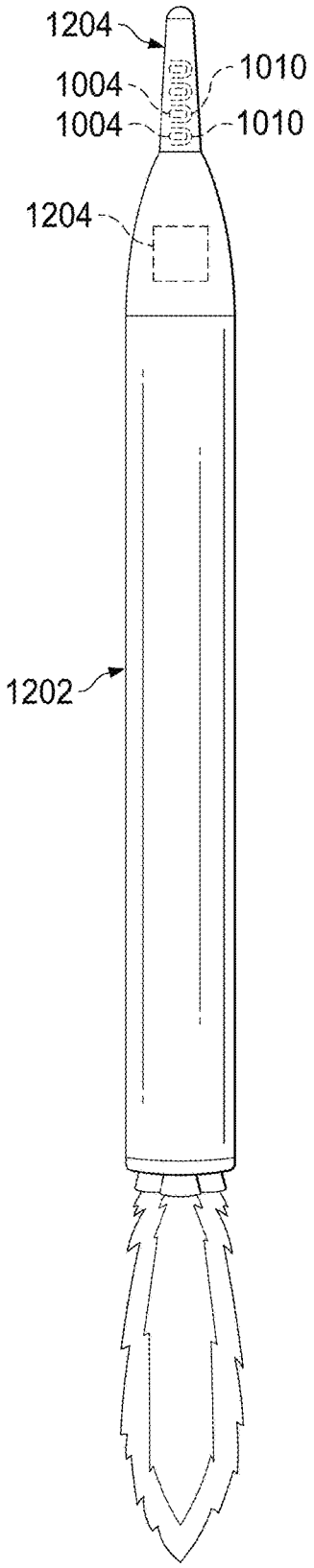
FIG. 12A illustrates the bags and conduits stowed in a rocket during launch and FIG. 12B illustrates deployment of the bags and conduits in orbit after launch.
Figure 12B:
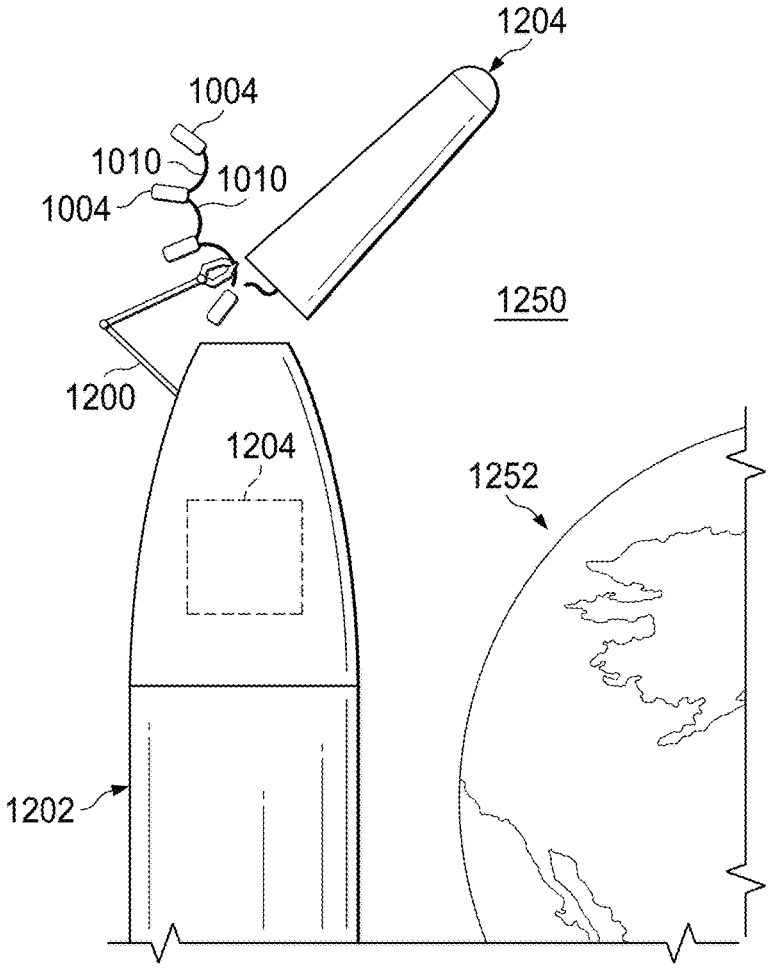

FIGS. 12A and 12B illustrate an example wherein a robot (e.g., robot arm 1200) connects the conduits 1010 to the bags so as to deploy the element, e.g., after a high g force launch of a rocket 1202 transporting a satellite including the bags into orbit around a planet (e.g., the Earth 1252). In some examples, the conduits 1010 and bags are stored in the nose cone 1204 of the rocket during the launch.

3. Fluidized Supports

Figure 13:
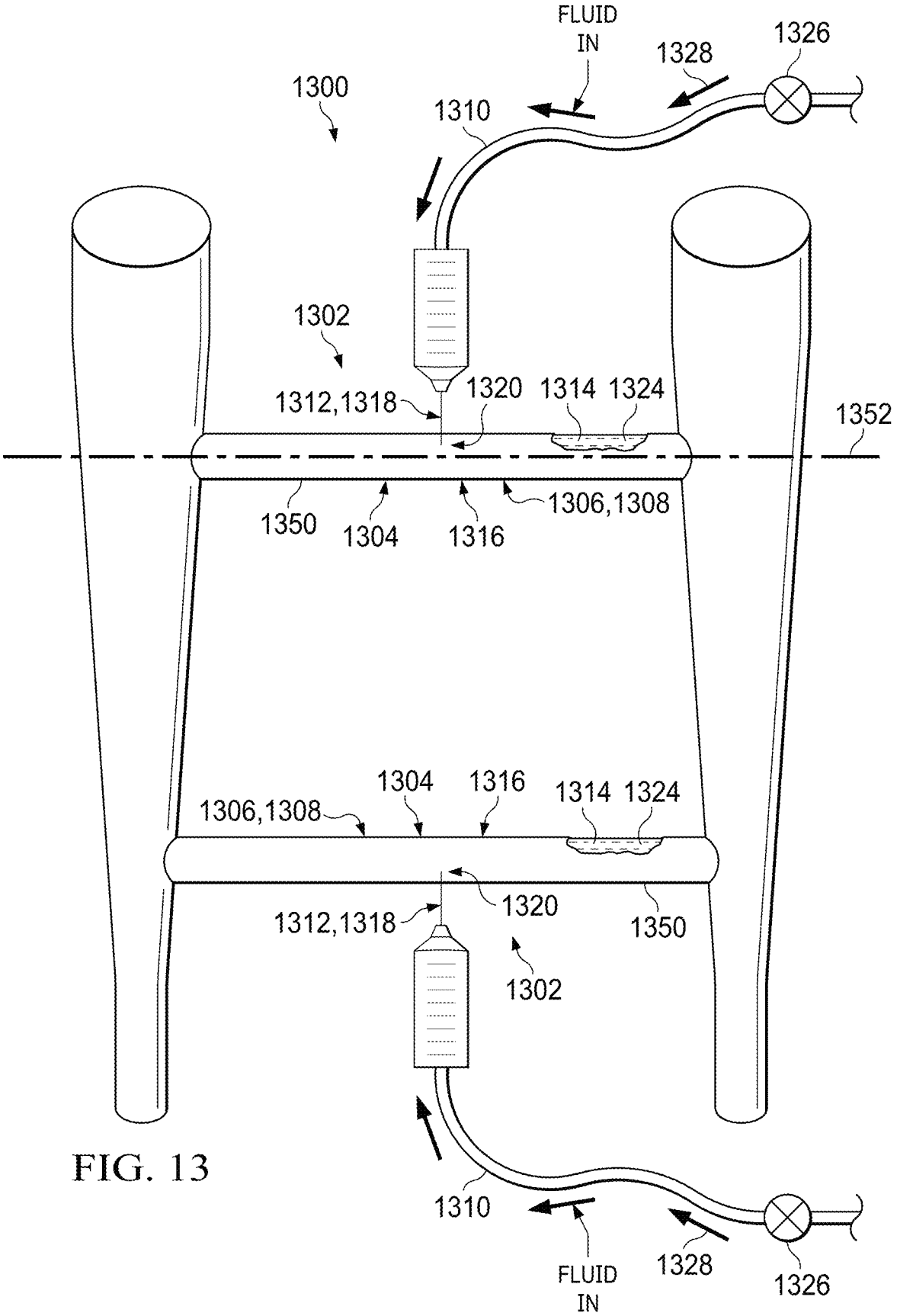
FIG. 13 illustrates fluid injection into support membranes enables high G force launch and subsequent deployment of large and complex structures.

FIG. 13 illustrates a system 1300 for deploying a support structure 1302, comprising one or more bags 1304 each having a wall 1306 comprising a membrane 1308; and one or more conduits 1310 each having an outlet 1312 transferring fluid 1314 into the one or more of the bags 1304 in fluidic communication with the conduits. The fluid pressurizes each of the one or more bags and expands the membrane so as to deploy and form each of the one or more bags into the support structure 1302.

Example materials for the membrane include, but are not limited to, an elastomer, a plastic, or a metal foil. Examples of the fluid include, but are not limited to, water or a mixture of fluids.

In one example, the outlet 1312 comprises a needle 1318 puncturing the membrane with a hole 1320 and injecting the fluid into the one or more bags 1304 through the hole. The hole is unsealed or sealed with, for example, a sealant 1324. In some examples, the fluid comprises the sealant. In one or more examples, the sealant comprises a liquid additive that is cured or becomes a solid to seal the hole upon ultraviolet radiation from a space environment. In yet further examples, the sealant comprises a liquid additive that is cured or becomes a solid upon exposure to the low gas pressure (vacuum) environment of space. In one or more examples, the sealant allows self healing or self-repairing in case of an object puncturing the bag or the membrane.

FIG. 13 further illustrates an example wherein the system includes one or more valves 1326 regulating one or more flows 1328 of the fluid into or out of the one or more bags, so as to control at least one of a deployment or a shape of the support. As illustrated in FIG. 13, in some examples the system further illustrates a heater 1100 outputting heat 1102 heating the fluid so as to cause an expansion of one or more the bags that controls the at least one of a shape or a deployment of the support. In yet further examples, the membrane comprises a material that contracts under cooling in outer space (the space environment) so as to control at least one of the shape or a deployment of the support. Example shapes include a surface 1350 of the support comprising a surface of revolution formed by rotating a line, a quadratic curve or parabola, or exponential curve about an axis of rotation coincident with the longitudinal axis 1352 of the support.

In one or more examples, the support comprises a support rod, support beam, or support strut.

Figure 14A:
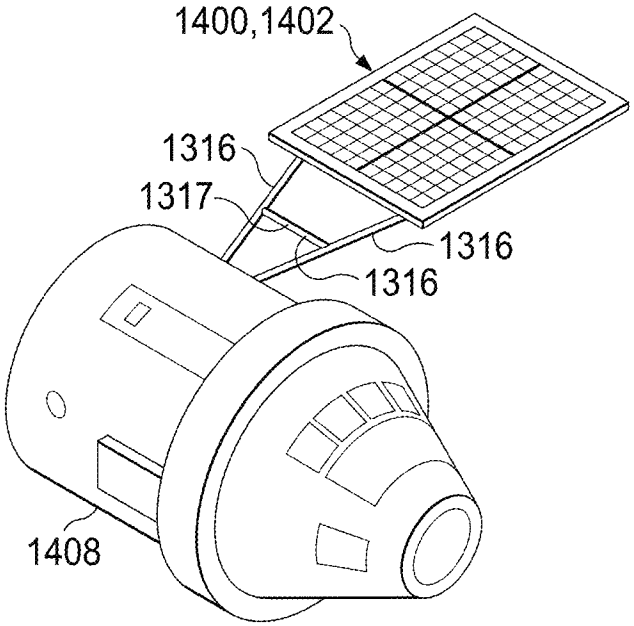
FIG. 14A illustrates the support structures supporting a solar panel on a spacecraft.
Figure 14B:
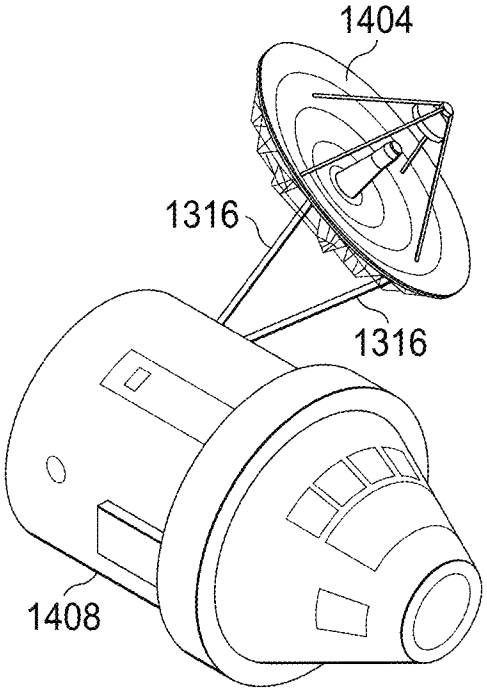
FIG. 14B illustrates the support structures supporting a satellite dish on a spacecraft.
Figure 14C:
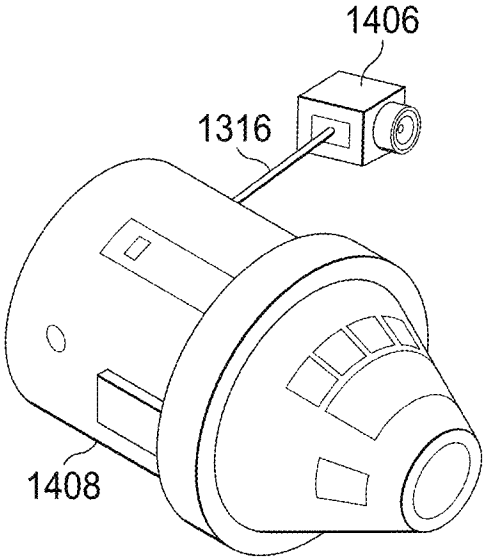
FIG. 14C illustrates the support structure supporting a camera on a spacecraft.

FIGS. 14A-14C illustrate examples wherein the support structure comprises a plurality of the supports 1316, 1317 each comprising a support rod deployed to mechanically support a structure 1400 or apparatus such as, but not limited to, a solar panel 1402, a satellite dish 1404, or a camera 1406 on a spacecraft 1408 (e.g., a satellite or a space station). In one or more examples, the support structure includes a cross support between the two existing supports, so that supports not only support a load but also support each other (e.g., one support rod supporting another support rod).

As illustrated in FIGS. 12A-12B, in some examples, a robot arm 1200 is used to connect the conduits to the bags so as to deploy the support structure from a rocket after the rocket has transported the spacecraft, the bags, the solar panel, the satellite dish, and/or the camera into orbit.

DEVICE EMBODIMENTS

Embodiments described herein include, but are not limited to, the following.

Waveguide Coupled Antenna Embodiments

A1. An apparatus, comprising:

a nanosatellite (200) or drone, including:

an antenna (202); and a waveguide (204) coupled to the antenna (202), the waveguide (204) comprising a dielectric:

focusing electromagnetic radiation (210) incident from free space (212) (e.g., air, atmosphere, vacuum and/or outer space in orbit around a planet) into the waveguide (204), waveguiding the electromagnetic radiation (210) to the antenna (202), and comprising at least one of a slot (300) or a taper (302).

A2. The apparatus (201) of paragraph A1, wherein the slot (300) is dimensioned to accommodate the antenna (202).

A3. The apparatus (201) of paragraphs A1 or A2, further comprising a mechanism (310) holding the antenna (202) at a position (312, 800) within the slot (300) where the electromagnetic radiation (210) has a peak electric field (400, 702) and wherein the antenna (202) is tuned to receive the peak electric field (400, 702).

A4. The apparatus (201) of any of the paragraphs A1-A3, wherein:

the waveguide (204) comprises a first end (314) and a second end (316), the antenna (202) is coupled to the second end (316), the taper (302) is at the first end (314) so that the first end (314) is narrower than the second end (316), and the waveguide (204) waveguides the electromagnetic radiation (210) from the first end (314) to the second end (316).

A5. The apparatus (201) of any of the paragraphs A1-A4, wherein the waveguide (204) comprises a rod having a dielectric constant of at least 5 for the electromagnetic radiation (210) having a frequency f in a range 100 MHz≤f≤1 GHz.

A6. The apparatus (201) of any of the paragraphs A1-A5, wherein the waveguide (204) comprises a rod having a width (304) a factor of at least a 100 times smaller than a wavelength of the electromagnetic radiation (210) in free space (212) and the dielectric constant shrinks the wavelength to confine the electromagnetic radiation (210) in a single mode within the waveguide (204).

A7. The apparatus (201) of any of the paragraphs A1-A6, wherein the waveguide (204) comprises a rod having a length (306) at least 2 times a diameter (D) of the rod.

A8. The apparatus (201) of any of the paragraphs A1-A7, wherein the waveguide (204) comprises a rod having a width (304) a range of 1-5 cm and a length (306) in a range of 5-20 cm and the electromagnetic radiation (210) comprises radio frequency radiation having a wavelength in a range of 30 cm to 1 meter.

A9. The apparatus (201) of any of the paragraphs A1-A8, wherein the rod comprises strontium titanate, fluid (1014, 1314), or alumina.

A10. The apparatus (201) of any of the paragraphs A1-A9, wherein the waveguide comprises a rod comprising ice or water.

A11. The apparatus (201) of any of the paragraphs A1-A10, wherein the waveguide (204) comprises a width (304) and dielectric constant wherein the waveguide (204) is impedance matched to the antenna (202) so as to tailor a gain and bandwidth of the antenna (202) for the electromagnetic radiation (210).

A12. The apparatus (201) of paragraphs A11, wherein the bandwidth is less than 3 dB for the electromagnetic radiation (210) having a center frequency f in a range of 100 MHz≤f≤1 GHz.

A13. The apparatus (201) of any of the paragraphs A1-A12, wherein the waveguide (204) comprises ice formed from water freezing in a bag (1004) (e.g., a bag comprising rubber, an elastomer, or plastic).

A14. The apparatus of any of the paragraphs A1-A13, wherein the waveguide (204) has circular, polygonal, or rectangular cross-section.

A15. The apparatus (201) of any of the paragraphs A1-A14, wherein the antenna (202) is a dipole antenna or probe.

A16. The apparatus (201) of any of the paragraphs A1-A16, wherein the slot (300) is filled with a liquid having a refractive index that matches that of the rod.

A17. The apparatus (201) of any of the paragraphs A1-A16 wherein the taper (302) has a linear, quadratic, or exponential shape (206).

A18. The apparatus (201) of any of the paragraphs A1-A17, wherein the antenna (202) is connected to a coaxial cable.

A19. The apparatus (201) of any of the paragraphs A1-A18, wherein the slot (300) has a first taper (324) and the waveguide (204) has a second taper (326).

A20. The apparatus (201) of any of the paragraphs A1-A19, wherein a front face (303) of the waveguide comprising a rod has an antireflective coating that is antireflective for the electromagnetic radiation (210).

A21. A high refractive index tapered rod (301) placed in between the antenna and the RF wave, so that the RF wave is focused, its amplitude is increased, and its wavelength reduced by factor comparable to the inverse of the rod's refractive index. Focusing the RF wave provides signal gain. Reducing the RF wavelength allows for the antenna length to be significantly reduced. Both of these benefits are a result of the high refractive index rod that is placed in front of the antenna.

Fluidized Element for Transmitting or Receiving Electromagnetic Radiation

B1. A system (1000) for deploying an element (1002) for transmitting or receiving electromagnetic radiation (210), comprising:

one or more bags (1004) each having a wall (1006) comprising a membrane (1008); and one or more conduits (1010) (e.g., each comprising a hose) each having an outlet (1012) transferring a fluid (1014) into the one or more of the bags (1004) in fluidic communication with the conduits (1010), wherein the fluid (1014) pressurizes the one or more bags (1004) and expands the membrane (1008) so as to deploy and form each of the one or more bags (1004) into a rigid structure (1016) comprising the element (1002) for transmitting or receiving electromagnetic radiation (210).

B2. The system (1000) of paragraph B1, wherein the outlet (1012) comprises a needle (1018) puncturing the membrane (1008) with a hole (1020) and injecting the fluid (1014) into each of the one or more bags (1004) through the hole (1020).

B3. The system (1000) of any of the paragraphs B1-B2, further comprising a sealant (1024) sealing the hole (1020).

B4. The system (1000) of any of the paragraphs B1-B3, wherein the fluid (1014) comprises the sealant (1024).

B5. The system (1000) of paragraph B4, further comprising a heater (1100) outputting heat (1102) activating the sealant (1024).

B6. The system (1000) of any of the paragraphs B1-B5, wherein the element (1002) comprises a waveguide (204) and/or antenna (202) having a gain and a bandwidth having a center frequency, or wherein the element comprises the waveguide coupled to the antenna as described in any of the paragraphs A1-A21.

B7. The system (1000) of paragraph B6, further comprising one or more valves (1026) regulating one or more flows (1028) of the fluid (1014) into or out of the one or more bags (1004), so as to tune the center frequency.

B8. The system (1000) of paragraphs B6 or B7, further comprising a heater (1100) heating the fluid (1014) so as to cause an expansion of the one or more bags (1004) that tunes the center frequency.

B9. The system (1000) of any of the paragraphs B1-B8, wherein the membrane (1008) comprises a material that contracts under cooling in outer space (1104) so as to tune the center frequency.

B10. The system (1000) of any of the paragraphs B1-B9, wherein the rigid structure (1016) comprises a rod (301).

B11. The system (1000) of any of the paragraphs B1-B10, further comprising a reservoir (1036) storing the fluid (1014), wherein the reservoir (1036) contains only enough fluid (1014) to form one of the bags (1004).

B12. The system (1000) of any of the paragraphs B1-B11, further comprising a robot connecting the conduits (1010) to the bags (1004).

B13. The system (1000) of paragraph B12, further comprising a computer instructing the robot to connect the conduits (1010) to deploy the element (1002) after a high g force launch of a rocket (1202) transporting a satellite comprising the bags (1004) into orbit.

B14. The system (1000) of any of the paragraphs B1-B13, wherein the rigid structure (1016) comprises a taper (302).

B15. The system (1000) of paragraph B14, wherein the taper (302) has a linear, quadratic, or exponential shape (206).

B16. The system (1000) of paragraph B14 or B15, wherein the taper (302) varies from a first shape (206) to a second shape (206).

B17. The system (1000) of any of the paragraphs B1-B16, wherein the fluid (1014) comprises a mixture of two or more fluids.

B18. The system (1000) of any of the paragraphs B1-B17, wherein the membrane (1008) comprises an elastomer (e.g., rubber), a plastic, or a metal foil and the fluid (1014) comprises water.

B19. A method for deploying an element (1002) for transmitting or receiving electromagnetic radiation (210), comprising:

providing one or more bags (1004) each having a wall (1006) comprising a membrane (1008);

connecting one or more conduits (1010) each having an outlet (1012) in fluidic communication with one or more of the bags (1004); and transferring fluid (1014) from the conduits (1010) into one or more of the bags (1004) through the outlet (1012), wherein the fluid (1014) pressurizes the bag and expands the membrane (1008) to deploy and form each of the one or more bags (1004) into a rigid structure (1016) comprising the element (1002) for transmitting or receiving electromagnetic radiation (210).

B20. An element (1002) for transmitting or receiving electromagnetic radiation (210), comprising:

one or more bags (1004) each having a wall (1006) comprising a membrane (1008); and a fluid (1014) contained in the one or more bags (1004), the fluid (1014) forming the bag into a rigid structure (1016) comprising the element (1002) for transmitting or receiving electromagnetic radiation (210).

Figure 15:
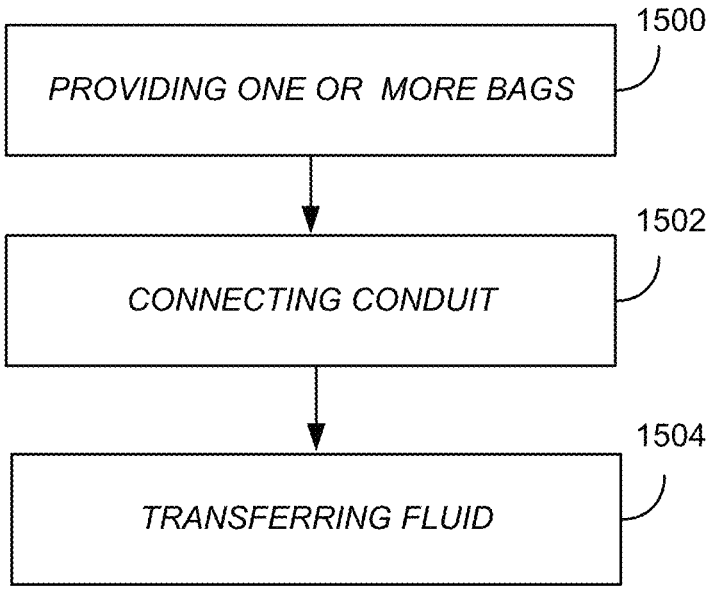
FIG. 15 illustrates a method for deploying an element.

B21. FIG. 15 illustrates a method for deploying an element (1002) for transmitting or receiving electromagnetic radiation (210), comprising:

providing (Block 1500) one or more bags (1004) each having a wall (1006) comprising a membrane (1008);

optionally connecting (Block 1502) one or more conduits (1310); and transferring (Block 1504) a fluid (1014) into the one or more of the bags (1004) using one or more conduits (1010) each having an outlet (1012) in fluidic communication with the bags, wherein the fluid (1014) fills, inflates, fluidizes and/or pressurizes the one or more bags (1004) and expands the membrane (1008) so as to deploy and form each of the one or more bags (1004) into a rigid structure (1016) comprising the element (1002) for transmitting or receiving electromagnetic radiation (210).

B22. The method of paragraphs B21 using the system of any of the paragraphs B1-B20.

B23. The apparatus (201) of any of the paragraphs A1-A21 comprising the system of any of the paragraphs B1-B20.

Fluidized Support Embodiments

C1. A system (1300) for deploying a support structure (1302), comprising:

one or more bags (1304) each having a wall (1306) comprising a membrane (1308); and one or more conduits (1310) each having an outlet (1312) transferring a fluid (1314) into the one or more of the bags (1304) in fluidic communication with the conduits (1310), wherein the fluid (1314) pressurizes each of the one or more bags (1304) and expands the membrane (1308) so as to deploy and form each of the one or more bags (1304) into one or more supports (1316).

C2. The system (1300) of paragraph C1, wherein the outlet (1312) comprises a needle (1318) puncturing the membrane (1308) with a hole (1320) and injecting the fluid (1314) into the each of the one or more bags (1304) through the hole (1320).

C3. The system (1300) of paragraph C2, further comprising a sealant (1324) sealing the hole (1320).

C4. The system (1300) of paragraph C3, wherein the fluid (1314) comprises the sealant (1324).

C5. The system (1300) of paragraph C2 or C3, further comprising a heater (1100) outputting heat (1102) activating the sealant (1324).

C6. The system (1300) of any of the paragraphs C2-C5, wherein the support structure (1302) is deployed in a space environment 1250 (e.g., a vacuum, outer space in orbit around a planet, free space) and the sealant (1324) contains or comprises a liquid additive that is cured or becomes a solid upon ultraviolet radiation from the space environment (1250).

C7. The system (1300) of any of the paragraphs C2-C6, wherein the sealant (1324) contains or comprises a liquid additive that is cured or becomes a solid upon exposure to a low gas pressure environment in space.

C8. The system (1300) of any of the paragraphs C1-C7, wherein the one or more supports (1316) each comprise a support rod or support beam.

C9. The system (1300) of any of the paragraphs C1-C8, wherein the support structure (1302) comprises a plurality of the supports (1316) each comprising a support rod deployed so as to support a solar panel (1402), a satellite dish (1404), a camera (1406) on a spacecraft (1408), or an additional support rod (1317).

C10. The system (1300) of any of the paragraphs C1-C9, further comprising a heater (1100) heating the fluid (1314) so as to cause an expansion of one or more the bags (1304) that controls the at least one of a shape (206) or a deployment of the supports (1316).

C11. The system (1300) of any of the paragraphs C1-C10, wherein the shape (206) of the supports is a linear, quadratic, or exponential shape (206).

C12. The system (1300) of any of the paragraphs C1-C11, further comprising one or more valves (1326) regulating one or more flows (1328) of the fluid (1314) into or out of the one or more bags (1304), so as to control at least one of a deployment or a shape (206) of the supports (1316).

C13. The system (1300) of any of the paragraphs C1-C12, wherein the membrane (1308) comprises a material that contracts under cooling in outer space (1104) so as to control at least one of a shape (206) or a deployment of the supports (1316).

C14. The system (1300) of any of the paragraphs C1-13, wherein the membrane (1308) comprises an elastomer (e.g., rubber) or plastic and the fluid (1314) comprises water.

C15. The system (1300) of any of the paragraphs C14, further comprising a robot connecting the conduits (1310) to the bags (1304).

C16. The system (1300) of paragraph C15, further comprising a computer instructing the robot to connect the conduits (1310) to deploy the support structure (1302) after a high g force launch of a rocket (1202) transporting a satellite comprising the bags (1304) into an orbit around a planet (1252).

C17. A method for deploying an element (1002) for transmitting or receiving electromagnetic radiation (210), comprising:

providing one or more bags (1304) each having a wall (1306) comprising a membrane (1308);

connecting one or more conduits (1310) each having an outlet (1312) in fluidic communication with one or more of the bags (1304); and transferring fluid (1314) from the conduits (1310) into one or more of the bags (1304) through the outlet (1312), wherein the fluid (1314) pressurizes the one or more bags (1304) and expands the membrane (1308) so as to deploy and form each of the one or more of the bags (1304) into one or more supports (1316).

C18. A support structure (1302) structure (1400), comprising:

one or more bags (1304) each having a wall (1306) comprising a membrane (1308); and a fluid (1314) contained in the one or more bags (1304), the fluid (1314) forming each of the one or more bags (1304) into a support for an apparatus on a spacecraft (1408).

C19. The support structure (1302) of any of the paragraphs C1-C5 18 deployed so as to support a solar panel (1402), a satellite dish (1404), a camera (1406) on a spacecraft (1408), or another/additional support rod (1317).

C20. A method for deploying a support structure (1302), comprising:

providing one or more bags (1304) each having a wall (1306) comprising a membrane (1308); and transferring fluid into the bags (1304) using one or more conduits (1310) each having an outlet (1312) in fluidic communication with the bags, wherein the fluid (1314) inflates, fills, fluidizes and/or pressurizes each of the one or more bags (1304) and expands the membrane (1308) so as to deploy and form each of the one or more bags (1304) into one or more supports (1316).

C21. The method of paragraphs C20 implemented using the system of any of the paragraphs C1-C17.

CONCLUSION

This concludes the description of the preferred embodiments of the present disclosure. The foregoing description of the preferred embodiment has been presented for the purposes of illustration and description. It is not intended to be exhaustive or to limit the disclosure to the precise form disclosed. Many modifications and variations are possible in light of the above teaching. It is intended that the scope of rights be limited not by this detailed description, but rather by the claims appended hereto.

What is claimed is:

1. An apparatus, comprising:

a nanosatellite or drone, including:

an antenna; and a waveguide coupled to the antenna, the waveguide comprising a dielectric and having a first end and a second end wherein the first end is narrower than the second end and the antenna is coupled to the second end, the waveguide focusing electromagnetic radiation incident from free space into the waveguide, and waveguiding the electromagnetic radiation to the antenna from the first end to the second end; and wherein the waveguide comprises at least one of a slot extending from one side of the waveguide to a diametrically opposed side of the waveguide or a taper at the first end.

2. The apparatus of claim 1, wherein the slot is dimensioned to accommodate the antenna.

3. The apparatus of claim 2, further comprising a mechanism holding the antenna at a position within the slot where the electromagnetic radiation has a peak electric field and wherein the antenna is tuned to receive the peak electric field.

4. The apparatus of claim 1, wherein the waveguide comprises a rod having a dielectric constant of at least 5 for the electromagnetic radiation having a frequency f in a range 100 MHz≤f≤1 GHz.

5. The apparatus of claim 4, wherein the rod has a width a factor of at least a 100 times smaller than a wavelength of the electromagnetic radiation in free space and the dielectric constant shrinks the wavelength to confine the electromagnetic radiation in a single mode within the waveguide.

6. The apparatus of claim 4, wherein the rod has a length at least 2 times a diameter of the rod.

7. The apparatus of claim 4, wherein the rod has a width a range of 1-5 cm and a length in a range of 5-20 cm and the electromagnetic radiation comprises radio frequency radiation having a wavelength in a range of 30 cm to 1 meter.

8. The apparatus of claim 4, wherein the rod comprises strontium titanate, fluid, or alumina.

9. The apparatus of claim 4, wherein the rod comprises ice or water.

10. The apparatus of claim 1, wherein the waveguide comprises a width and dielectric constant wherein the waveguide is impedance matched to the antenna so as to tailor a gain and bandwidth of the antenna for the electromagnetic radiation.

11. The apparatus of claim 10, wherein the bandwidth is less than 3 dB for the electromagnetic radiation having a center frequency fin a range of 100 MHz≤f≤1 GHz.

12. The apparatus of claim 1, wherein the waveguide comprises frozen water in a bag.

13. The apparatus of claim 1, wherein the waveguide has circular, polygonal, or rectangular cross-section.

14. The apparatus of claim 1, wherein the antenna is a dipole antenna or probe.

15. The apparatus of claim 1, wherein the slot is filled with a liquid having a refractive index that matches that of the dielectric.

16. The apparatus of claim 1, wherein the taper has a linear, quadratic, or exponential shape.

17. The apparatus of claim 1, wherein the antenna is connected to a coax cable.

18. The apparatus of claim 1, wherein the slot has a first taper and the waveguide has a second taper.

19. The apparatus of claim 1, wherein a front face of the waveguide comprising a rod has an antireflective coating that is anti-reflective for the electromagnetic radiation.

20. The apparatus of claim 1, wherein the waveguide comprises a bag having a wall including a membrane having fluid therein, the fluid pressurized to expand the membrane to form a rigid structure.

* * * * *